US006745121B2

(12) United States Patent
Watanuki et al.

(10) Patent No.: US 6,745,121 B2
(45) Date of Patent: Jun. 1, 2004

(54) CYLINDER INDENTIFICATION APPARATUS FOR WT CONTROLLED INTERNAL COMBUSTION ENGINE

(75) Inventors: Takuo Watanuki, Tokyo (JP); Eiji Kanazawa, Tokyo (JP); Shiro Yonezawa, Tokyo (JP); Tomokazu Makino, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 22 days.

(21) Appl. No.: 10/288,467

(22) Filed: Nov. 6, 2002

(65) Prior Publication Data

US 2004/0010363 A1 Jan. 15, 2004

(30) Foreign Application Priority Data

Jul. 11, 2002 (JP) ..... 2002-202458

(51) Int. Cl.[7] ..... F02P 5/15; F02D 45/00

(52) U.S. Cl. ..... 701/114; 73/116; 123/406.62

(58) Field of Search ..... 701/110, 114, 701/102; 73/116, 117.3; 123/406.18, 406.62, 406.63

(56) References Cited

U.S. PATENT DOCUMENTS 5,630,396 A * 5/1997 Fukui et al. ..... 123/406.18

6,644,273 B1 * 11/2003 Hagari et al. ..... 123/406.62

FOREIGN PATENT DOCUMENTS

JP 08-277744 10/1996

JP 11-351051 A * 12/1999 ..... F02D/45/00

* cited by examiner

*Primary Examiner*—Hieu T. Vo

(74) *Attorney, Agent, or Firm*—Sughrue Mion, PLLC

(57) ABSTRACT

A crank angle position signal is generated which corresponds to rotational angles of a crankshaft and includes a specific signal for obtaining reference crank angle positions of cylinders. A cylinder identification signal is generated corresponding to the respective cylinders in accordance with the rotation of at least one of an intake-side cam and an exhaust-side cam which are subjected to VVT control. Correlation between the reference crank angle positions and cylinder groups is specified based on a combination of the reference crank angle positions and the cylinder identification signal. Cylinder identification ranges of a prescribed angular length in consideration of an advance angle and a retard angle are set based on the reference crank angle positions. The cylinders are identified based on the reference crank angle positions whose correlation with cylinder groups within each of the cylinder identification ranges has been specified, and the cylinder identification signal.

14 Claims, 17 Drawing Sheets

PW1 : SPECIFIC CYLINDER PULSE WIDTH
τ : L LEVEL RANGE
θR : REFERENCE POSITION

CYLINDER INDENTIFICATION APPARATUS FOR WT CONTROLLED INTERNAL COMBUSTION ENGINE

BACKGROUND OF THE INVENTION

1. Field of the Invention

The present invention relates to a cylinder identification apparatus for an internal combustion engine installed on a vehicle such as a motor vehicle, and more particularly to such a cylinder identification apparatus as can be applied to an internal combustion engine that is controlled at variable valve timing.

2. Description of the Related Art

FIG. 16 is a block diagram that shows the configuration of this kind of conventional cylinder identification apparatus for an internal combustion engine disclosed in Japanese Patent Application Laid-Open No. 8-277744 for instance. FIG. 17 is a view that shows the configuration of each signal detector in FIG. 16. FIG. 18 is a waveform diagram that shows one example of each of a first signal sequence and a second signal sequence in FIG. 16.

In these figures, a camshaft 1 with a speed reduction ratio of ½ with respect to a crankshaft 11 of the internal combustion engine is driven to rotate by and in synchronization with the crankshaft 11 through a belt drive mechanism or the like. A first signal detector 81 for generating a first signal sequence POSR related to the rotation of the crankshaft 11 includes a rotating disk 12 integrally mounted on the crankshaft 11, a multitude of projections or teeth 81*a* formed at a first prescribed angular interval (e.g., crank angle of 1°–10°) along the outer periphery of the rotating disk 12, and a sensor 81*b* of the magnetic pickup type, the Hall effect type, the magneto-resistance type, etc., arranged in the vicinity of the outer periphery of the rotating disk 12 for sensing each projection 81*a* when its sensing portion comes to face therewith.

The first signal sequence POSR includes a crank angle signal generated at each first prescribed angle or angular interval in synchronization with the rotation of the crankshaft 11, and a reference position signal generated at each second prescribed angle or angular interval (e.g., crank angle of 360°) and corresponding to a reference position of a specific group of cylinders (in this case, cylinder #1 and cylinder #4 to be concurrently controlled) of the internal combustion engine.

The projections 81*a* corresponding to the respective pulses of the crank angle signal in the first signal sequence POSR includes an untoothed or lost teeth portion 80 (see FIG. 17) in the form of an angular range (i.e., a range where there exists no projection 81*a*) in which no crank angle signal is continuously generated over a crank angle of ten degrees to several tens degrees. An end position of the untoothed portion 80 (i.e., the position at which the next angle signal begins to be generated) corresponds to the reference positions θR of the specific cylinder group. The untoothed portion 80 is arranged at one location (i.e., every crank angle of 360°) on the rotating disk 12 formed integral with the crankshaft 11.

A second signal detector 82 for generating a second signal sequence SGC related to the rotation of the camshaft 1 includes a rotating disk 2 integrally mounted on the camshaft 1, projections 82*a* formed on and along the outer periphery of the rotating disk 2 at locations corresponding to the respective cylinders (in this case, four cylinders), and a sensor 82*b* in the form of an electromagnetic pickup arranged in the vicinity of the outer periphery of the rotating disk 2 for sensing each projection 82*a* when its sensing portion comes to face therewith.

In this case, the second signal sequence SGC consists of a train of pulses of a cylinder identification signal corresponding to the respective cylinders. The pulse width PW1 of a pulse of the cylinder identification signal corresponding to a specific cylinder (cylinder #1) differs from and is longer than the pulse widths PW2–PW4 of pulses corresponding to other cylinders. The first and second signal sequences POSR and SGC are input to a microcomputer 100 through an interface circuit 90.

The microcomputer 100 constitutes a control means for controlling parameters of the internal combustion engine. The microcomputer 100 includes a reference position signal detection means 101 for detecting a reference position signal related to the specific cylinder group from the first signal sequence POSR, a reference position detection means 101A for detecting the reference position of each cylinder based on the angle signal in the first signal sequence POSR and the reference position signal, a cylinder group identification means 102 for identifying cylinder groups based on the reference position signal, a cylinder identification means 103 for identifying each cylinder based on the ratio of generation times or durations of successive signal pulses in the second signal sequence SGC (cylinder identification signal), a control timing calculation means 104 for counting the number of angle signal pulses included in the first signal sequence POSR and calculating the control timing of control parameters P (ignition timing, etc.), and an abnormality determination means 105 for determining whether there is abnormality (or failure) in one of signal sequences POSR and SGC and outputting an abnormality determination signal E to the cylinder identification means 103 and the timing calculation means 104 when it is determined that one of the signal sequences POSR and SGC is abnormal.

Here, note that the cylinder identification means 103 identifies each cylinder based at least on the second signal sequence SGC, and the control timing calculation means 104 calculates the control timing of the control parameters P based at least on the cylinder identification result of the cylinder identification means 103 and the second signal sequence SGC.

For instance, when the first and second sequences POSR and SGC are normal, the cylinder identification means 103 measures the generation duration or range of each cylinder identification signal included in the second signal sequence SGC by counting pulses of the angle signal included in the first signal sequence POSR, so that it identifies each cylinder based on the measurement result, as will be described later. On the other hand, upon occurrence of abnormality (e.g., when there is obtained no first signal sequence POSR), the cylinder identification means 103 identifies each cylinder based on the calculation of the ratio of generation times or durations of successive pulses of the cylinder identification signal (e.g., duty ratio of adjacent or successive high (H) level and low (L) level ranges) by using only the second signal sequence SGC in response to an abnormality determination signal E, thus making it possible to perform backup control.

Similarly, when the first and second sequences POSR and SGC are normal, the control timing calculation means 104 calculates the control timing of the parameters P by using the reference position signal included in the first signal sequence POSR and the cylinder identification signal included in the second signal sequence SGC, and by counting the crank angle signal. In addition, upon occurrence of abnormality (e.g., when there is obtained no first signal sequence POSR), the control timing calculation means 104 performs the backup control by using only the second signal sequence SGC in response to an abnormality determination signal E. Moreover, when the second signal sequence SGC is not obtained, the control timing calculation means 104 performs the backup control through simultaneous ignition of each cylinder group or the like by using only the cylinder identification result of the cylinder group identification means 102 based on the first signal sequence POSR.

Incidentally, note that at normal time, the control timing calculation means 104 determines the control parameters P such as the ignition timing, the amount of fuel to be injected, etc., through calculations using a map for example, based on engine operating condition signals D from various sensors (not shown), and supplies them to the respective cylinders.

Next, the operation of the conventional apparatus shown in FIG. 16 and FIG. 17 will be explained while referring to FIG. 18. First of all, the rotating disk 12 with the projections 81*a* formed at the first prescribed angular interval is mounted on the crankshaft 11, and the sensor 81*b* is arranged in opposition to the projections 81*a*. In this manner, the first signal detector 81 is constructed such that it generates the first signal sequence POSR including the angle signal and the reference position signal.

At this time, the untoothed or lost tooth portion 80 is provided at a part of the projections 81*a* (e.g., at one location on the rotating disk 12 in case of a four-cylinder engine) in order that not only the angle signal but also the reference position signal corresponding to each cylinder group is included in the first signal sequence POSR.

The untoothed portion 80 is detected by the sensor 81*b* that converts the presence or absence of a projection 81*a* into the first signal sequence POSR (electrical signal). Subsequently, an L level range $\tau$ (corresponding to the untoothed portion 80) included in the first signal sequence POSR is detected by the reference position signal detection means 101 in the microcomputer 100 based on the magnitude of each pulse generation period or cycle.

As a result, the first signal sequence POSR (see FIG. 18), which is generated in correspondence to the projections 81*a* as the crankshaft 11 rotates, includes the crank angle signal that consists of a train of pulses generated every first prescribed angle (e.g., crank angle of 1°) and the reference position signal generated every crank angle of 360° that consists of an L level range (e.g., a range in which no crank angle signal is obtained over only a prescribed angular interval from a crank angle of ten degrees to several tens degrees) corresponding to the untoothed portion 80.

Here, note that the end position of each L level range $\tau$ (i.e., the position at which the following crank angle signal begins to be generated) becomes the reference position $\theta R$ used for the calculation of the control timing of the specific cylinder group. Accordingly, the cylinder group identification means 102 identifies the specific cylinder group and other cylinder groups based solely on the reference position signal from the reference position signal detection means 101, so that the control timing calculation means 104 can quickly identify groupwise ignitable cylinder groups. As a result, the minimum internal combustion engine control performance can be obtained.

In addition, the second signal sequence SGC generated in correspondence to the projections 82*a* on the rotating disk 2 mounted on the camshaft 1 includes the cylinder identification signal in which the pulse width PW1 of the pulse corresponding to the specific cylinder (cylinder #1) is set longer than that of pulses corresponding to other cylinders so that the cylinder identification means 103 can identify the specific cylinder and the other cylinders, and the control timing calculation means 104 can obtain the desired internal combustion engine control performance based on the cylinder identification result.

At this time, in cases where the first and second signal sequences POSR and SGC are soundly or correctly obtained, the cylinder identification means 103 measures the pulse width of each signal pulse in the second signal sequence SGC by counting the number of pulses of the crank angle signal in the first signal sequence POSR, whereby it identifies the specific cylinder and the other cylinders.

On the other hand, in cases where no first signal sequence POSR is obtained due to a failure of the sensor 81*b*, etc., on the crankshaft 11 side (i.e., when the first signal sequence POSR always indicates a constant level or an abnormal pulse width), the abnormality determination means 105 generates an abnormality determination signal E, which is then input to the cylinder group identification means 102, the cylinder identification means 103 and the control timing calculation means 104. As a consequence, the cylinder identification means 103 performs cylinder identification by using the second signal sequence SGC alone, thereby enabling the backup control of the control parameters P for the internal combustion engine.

That is, the ratios between the cycle or period of an H level and that of an L level of pulses of the second signal sequence SGC are successively calculated and compared with each other, whereby the specific cylinder pulse of the pulse width PW1 having the largest H level period or range is identified, thus determining the specific cylinder. Thereafter, the other cylinders are sequentially identified based on the specific cylinder pulse. At this time, for instance, by making the fall timing of each pulse of the second signal sequence SGC the ignition timing of each cylinder, it is possible to provide the minimum internal combustion engine control performance.

In addition, when the second signal sequence SGC is not obtained due to a failure of the sensor 82*b*, etc., on the camshaft 1 side, the control timing calculation means 104 performs the backup control in accordance with simultaneous ignition control or the like based solely on the cylinder group identification result according to the reference position signal in the first signal sequence POSR. In this manner, the minimum internal combustion engine control performance can be obtained.

The first signal detector 81 for detecting the first signal sequence POSR including the crank angle signal and the reference position signal is provided on the crankshaft 11 side, and the second signal detector 82 for detecting the second signal sequence SGC including the cylinder identification signal is arranged on the camshaft 1 side, so that the crank angle and the reference position $\theta R$ can be accurately detected without generating a phase difference or shift between the camshaft 1 and the crankshaft 11 that drives the camshaft 1 due to the interposition of a transmission mechanism such as a belt and pulley transmission mechanism therebetween. Consequently, it is possible to accurately control the ignition timing and the amount of fuel to be injected to each cylinder.

In addition, by setting a reference position signal for the specific cylinder group, the specific cylinder group can be identified every time a reference position $\theta R$ is detected so that all the cylinder groups can be detected quickly and easily. Thus, the ignition timing control and the fuel injection control particularly upon engine starting can be performed quickly and appropriately.

Moreover, even when the first signal sequence POSR is not obtained due to a failure of the first detector 81, etc., the cylinders and the control reference position can be identified by calculating the ratios of the successive cycles or periods of pulses of the second signal sequence SGC, whereby the ignition timing control and the fuel injection control can be continued without stopping the internal combustion engine (i.e., backup control being able to be performed).

Although in the above-mentioned explanation, the pulse width PW1 of the specific cylinder is made different from those of the other cylinders as a difference in the pulse form of the cylinder identification signal between the specific cylinder and the other cylinders, only the pulse corresponding to the specific cylinder may be superposed in phase on the reference position signal so that the specific cylinder can be identified based on the level of the second signal sequence SGC at each reference position θR.

FIG. 19 is a waveform diagram showing an operation when the pulse of the cylinder identification signal corresponding to the specific cylinder is superposed on the phase of the reference position signal. Here, note that the pulse width PW1 of the pulse corresponding to the specific cylinder is set to be longer than the pulse width of each of the other cylinders. If, however, the phase of the pulse of the cylinder identification signal corresponding to the specific cylinder is superposed on the phase of the reference position signal, the pulse width of the cylinder identification signal corresponding to the specific cylinder may be the same as the pulse width of the other cylinders.

In FIG. 19, the phase of the second signal sequence SGC for the specific cylinder (cylinder #1) is superposed on the phase of the reference position signal included in the first signal sequence POSR, and becomes an H level at a corresponding reference position θR. On the other hand, the phases of pulses of the second signal sequence SGC corresponding to the other cylinders are not superposed on the phase of the reference position signal, and hence become an L level at corresponding reference positions θR.

That is, the pulse of the cylinder identification signal corresponding to the specific cylinder (cylinder #1) indicated by the pulse width PW1 is at an H level over a range including an L level range τ of the first signal sequence POSR, whereas the pulses of the cylinder identification signal corresponding to the other cylinders (cylinder #3, cylinder #4 and cylinder #2) become an H level immediately after corresponding reference positions θR obtained from the first signal sequence POSR.

Accordingly, it is understood that if the second signal sequence SGC is at an H level at a reference position θR, it corresponds to the pulse of the specific cylinder, whereas if it is at an L level, it corresponds to a pulse of any of the other cylinders. As a result, the cylinder identification means 103 identifies the specific cylinder from the level of the second signal sequence SGC at the point in time at which a reference position θR has been detected by the reference position detection means 101A. Thereafter, the other cylinders are sequentially identified based on the specific cylinder.

In addition, identifying the cylinders by referring to the level of the second signal sequence SGC each time the reference position θR is detected can eliminate the need of measuring pulse widths, etc.

Thus, in the past, when the crank angle position signal or the cylinder identification signal has failed or become abnormal, a minimum performance level has been maintained by performing the backup control by the use of another normal signal.

As mentioned above, such a kind of conventional apparatus can carry out cylinder identification quickly by a combination of the reference (crank angle) position signal and the crank angle signal generated in accordance with the rotation of the crankshaft, and the cylinder identification signal generated in accordance with the rotation of the camshaft. Since, however, the phase of the cylinder identification signal and the phase of the reference crank angle position signal are mutually superposed on each other, there arises the following problem. That is, in cases where this apparatus is applied to an internal combustion engine which is equipped with a variable valve timing mechanism, the phase of the cylinder identification signal might not be superposed on the phase of the reference crank angle position signal depending upon a variable cam phase range. As a result, cylinder identification becomes impossible, thus making it unable to perform the backup control.

In addition, in cases where the above-mentioned prior art is intended to be adapted to an internal combustion engine which is equipped with a variable valve timing mechanism, there will be another problem in that the combination of the reference crank angle position signal, the cylinder identification signal and the angle signal becomes complicated.

SUMMARY OF THE INVENTION

The present invention is intended to solve the problems as referred to above, and has its object to provide a cylinder identification apparatus of the character as described above which can be applied to an internal combustion engine that is subjected to variable valve timing control without complicating the combination of signals.

Bearing the above object in mind, the present invention resides in a cylinder identification apparatus for a VVT controlled internal combustion engine which includes: a crank angle position signal generator for generating a crank angle position signal including a train of pulses corresponding to rotational angles of a crankshaft of the internal combustion engine and specific signal pulses which are used to obtain a plurality of reference crank angle positions of respective cylinders of the internal combustion engine; and a cylinder identification signal generator for generating a cylinder identification signal including a train of pulses corresponding to the respective cylinders in accordance with the rotation of at least one of an intake-side cam and an exhaust-side cam which are caused to rotate at a ratio of ½ with respect to the rotational speed of the crankshaft and move to an advance angle position or a retard angle position under variable valve timing (VVT) control. The apparatus further includes: a reference crank angle position detection part for detecting the plurality of reference crank angle positions based on the specific signal pulse positions of the crank angle position signal; a reference crank angle position identification part for identifying correlation between the plurality of reference crank angle positions and cylinder groups based on a combination of the plurality of reference crank angle positions and the cylinder identification signal; a cylinder identification range setting part for setting cylinder identification ranges of a prescribed angular length with each of the reference crank angle positions as a reference in consideration of an advance angle and a retard angle according to the VVT control; and a cylinder identification part for identifying the cylinders based on the reference crank angle positions whose correlation with the cylinder groups within each of the cylinder identification ranges is specified and the cylinder identification signal.

According to the above arrangement, the cylinder identification apparatus can be applied to a VVT controlled internal combustion engine without complicating the processing of combining the signals upon cylinder identification. Specifically, cylinder identification ranges and signals are set in consideration of valve operation angles (e.g., intake valve operation angle and/or exhaust valve operation angle) so that cylinder identification can be performed irrespective of the valve operation angles.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Now, preferred embodiments of the present invention will be described below in detail while referring to the accompanying drawings.

Embodiment 1

Figure 1:
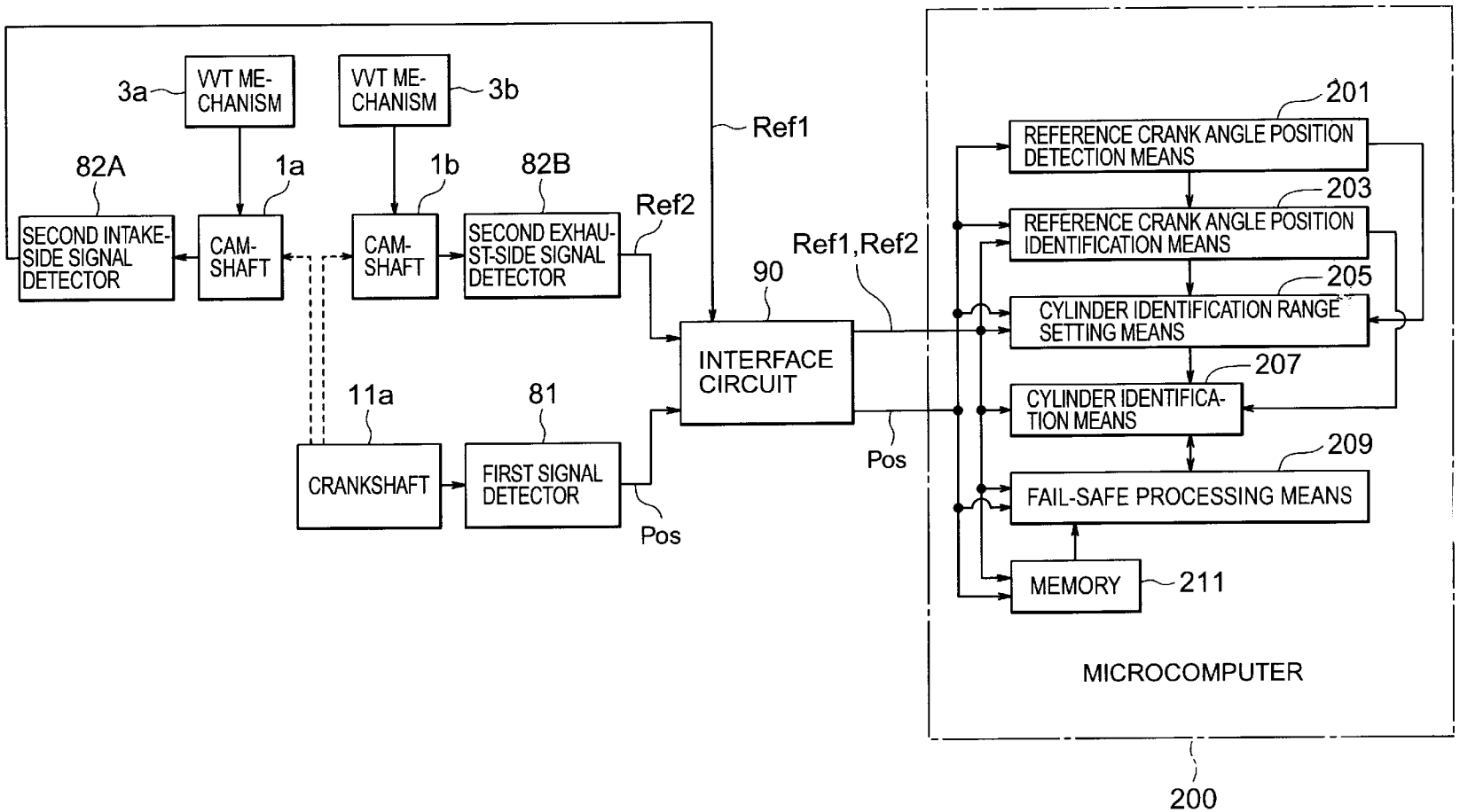
FIG. 1 is a block diagram showing the configuration of a cylinder identification apparatus for an internal combustion engine that performs variable valve timing control according to a first embodiment of the present invention.

FIG. 1 is a block diagram that shows the configuration of a cylinder identification apparatus for an internal combustion engine performing variable valve timing control according to a first embodiment of the present invention. In this invention, there are used a signal obtained by the rotation of a crankshaft 11*a* and signals obtained by the rotations of an intake-side camshaft 1*a* and an exhaust-side camshaft 1*b* (e.g., in case of a twin-cam engine), respectively, which are driven to rotate by and in synchronization with the crankshaft 11*a* through belt drive mechanisms, etc., at a speed reduction ratio of ½ with respect to the crankshaft 11*a*. The intake-side camshaft 1*a* and the exhaust-side camshaft 1*b* are placed under the control of variable valve timing (VVT) mechanisms 3*a* and 3*b*, respectively.

Figure 2:
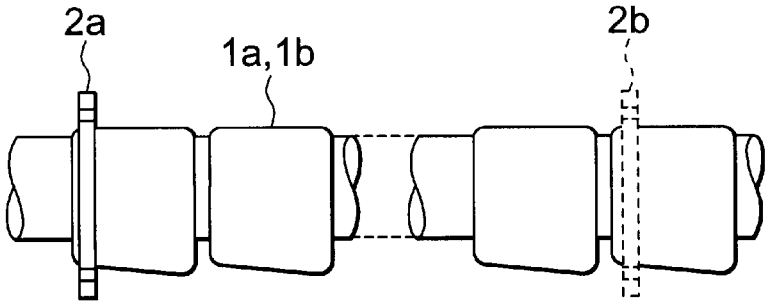
FIG. 2 is a view for explaining the configuration of a signal detector(s) in the cylinder identification apparatus according to the present invention.
Figure 3:
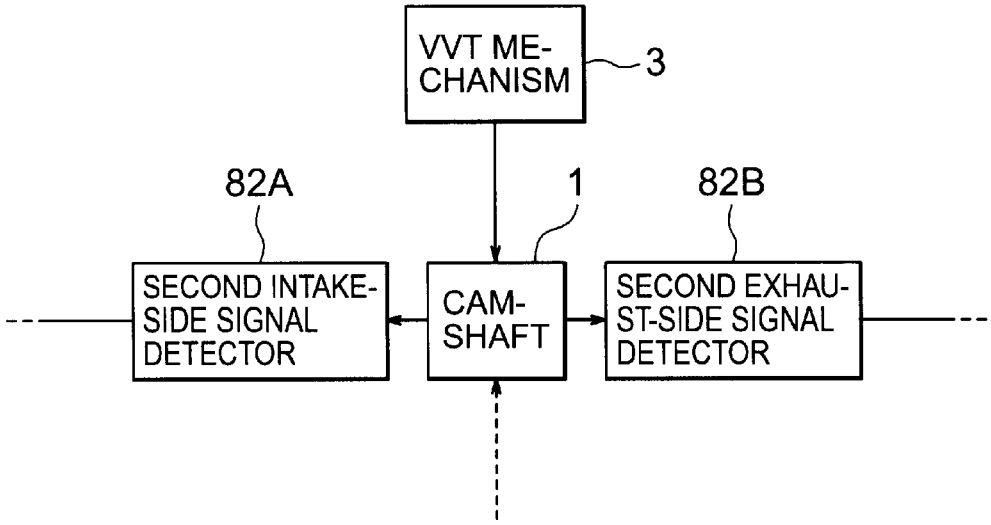
FIG. 3 is a view showing another example of the configuration of a signal detecting part of the cylinder identification apparatus according to the present invention.
Figure 4B:
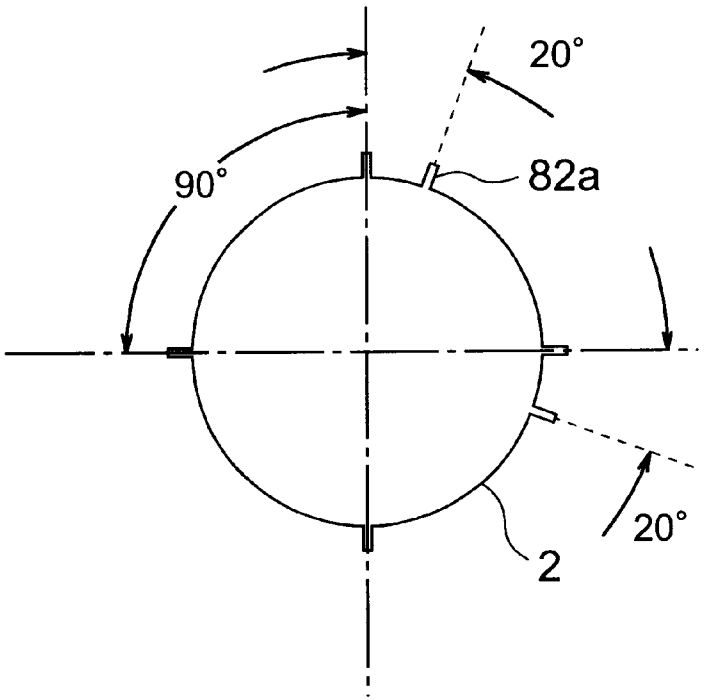
FIGS. 4A and 4B are views for explaining the configurations of signal detectors, respectively, in the cylinder identification apparatus according to the present invention.

The structure of the camshafts 1*a* and 1*b* are illustrated in FIG. 2. Mounted on the camshafts 1*a* and 1*b* are rotating disks 2*a*, respectively, which rotate together with the camshafts 1*a* and 1*b* which are provided on their outer peripheries with a plurality of projections to be described later in detail, as shown in FIG. 4B for instance, the projections on the rotating disks 2*a*, 2*b* being detected by sensors or the like to provide two cylinder identification signals. Here, note that FIG. 1 shows the case of a twin-cam engine, but in case of a single-cam engine, the construction of a camshaft 1 and its related portions is illustrated in FIG. 3. As shown in FIG. 2, the rotating disks 2*a*, 2*b* are mounted on an intake-side cam and an exhaust side cam, respectively, of the single camshaft for generation of two cylinder identification signals.

Figure 17:
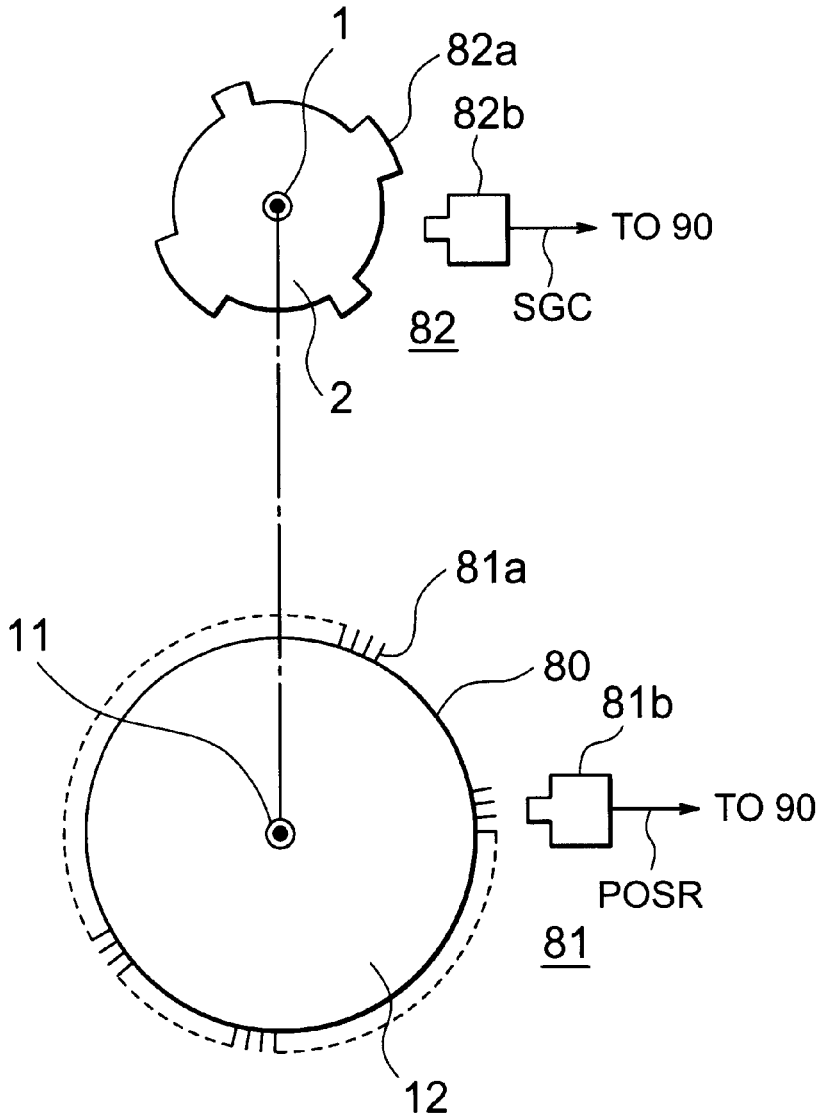
FIG. 17 is a view showing the configuration of respective signal detectors of FIG. 16.
Figure 18:
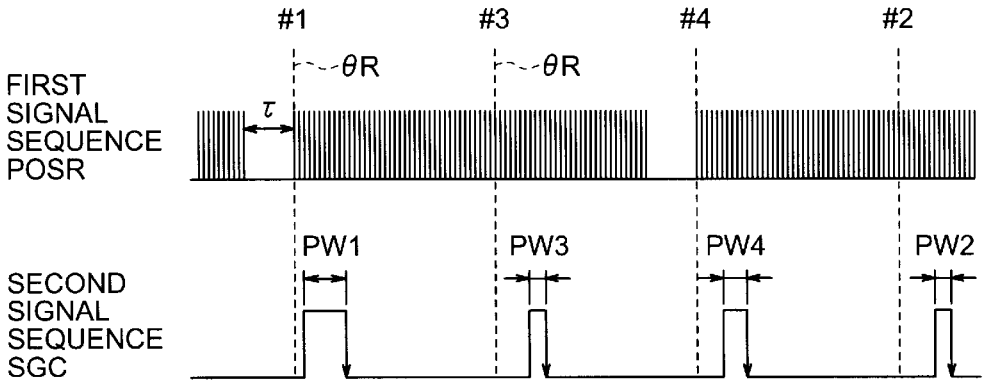
FIG. 18 is a waveform diagram showing one example of a first signal sequence and a second signal sequence of FIG. 16.
Figure 19:
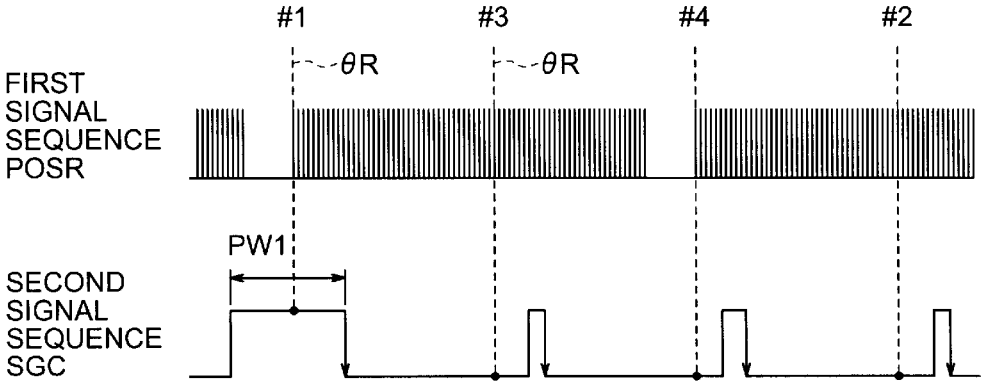
FIG. 19 is a waveform diagram for explaining the operation of another conventional cylinder identification apparatus.

Turning back to FIG. 1, a first signal detector 81, a second intake-side signal detector 82A and a second exhaust-side signal detector 82B are basically of the same structures as the corresponding signal detectors, respectively, as shown in FIG. 17. That is, a rotating disk is integrally formed with the crankshaft 11*a*, and similarly, rotating disks are integrally formed with the corresponding cams, respectively, which are in turn provided on the camshaft 1*a* and the camshaft 1*b*, respectively. Formed on the outer periphery of each of the rotating disks at prescribed intervals are a plurality of projections which are detected by a sensor that is arranged at a location adjacent to the outer periphery of each rotating disk.

Figure 4A:
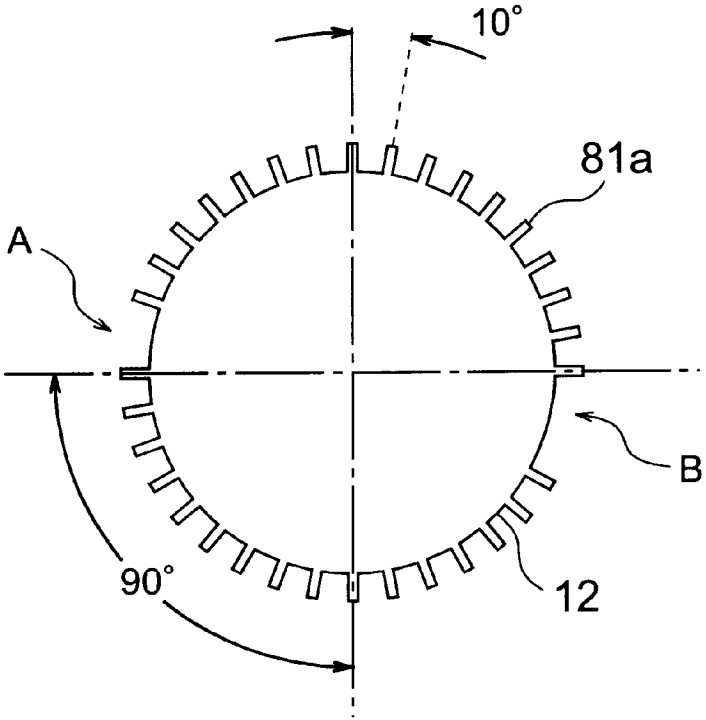

FIG. 4A shows one example of the arrangement of projections 81*a* of a rotating disk 12 mounted on the crankshaft 11*a* according to the present invention, and FIG. 4B shows one example of the arrangement of projections 82*a* of a rotating disk 2 mounted on each of the cams of the camshafts 1*a*, 1*b*. The patterns of the projections 82*a* of the rotating disks 2 on the camshafts 1*a*, 1*b* are identical with respect to each other. The projections 81*a* of the rotating disk 12 on the crankshaft 11*a* is arranged at intervals of 100 with a one-tooth lost portion A and a two-tooth lost portion B being formed on the outer periphery of the rotating disk 12 at substantially diametrically opposite positions. Four of the projections 82*a* of each of the rotating disks 2 on the camshafts 1*a*, 1*b* are arranged at intervals of 90° with additional two thereof each adjacent to a corresponding one of the four projections being arranged at an angle of 20° apart therefrom.

The first signal detector 81 generates a crank angle position signal Pos, whereas the second intake-side signal detector 82A and the second exhaust-side signal detector 82B generate a cylinder identification signal Ref1 (intake side) and a cylinder identification signal Ref2 (exhaust side), respectively. These signals are input to a microcomputer 100 through an interface circuit 90.

The microcomputer 200 includes a reference crank angle position detection means 201 for detecting a plurality of reference crank angle positions based on the crank angle position signal, a reference crank angle position identification means 203 for identifying the reference crank angle positions, a cylinder identification range setting means 205 for setting a cylinder identification range based on each reference crank angle position, a cylinder identification means 207 for identifying the cylinders of an internal combustion engine based on the number of pulses of the cylinder identification signal in each cylinder identification range, a fail safe processing means 209 for performing fail safe processing to be described later, and a memory means 211 for storing the numbers of detected pulses Ref (Nref21, Nref22) of the two cylinder identification signals and the number of lost teeth Nkake over a predetermined number of times (i.e., storing the history of these signals), as will be described later. It is to be noted that the microcomputer 200 may include a control timing calculation means and an abnormality determination means as in the aforementioned prior art, but they are omitted here since they have no direct or material relation with respect to cylinder identification which is the concerned feature of the present invention.

Figure 5:
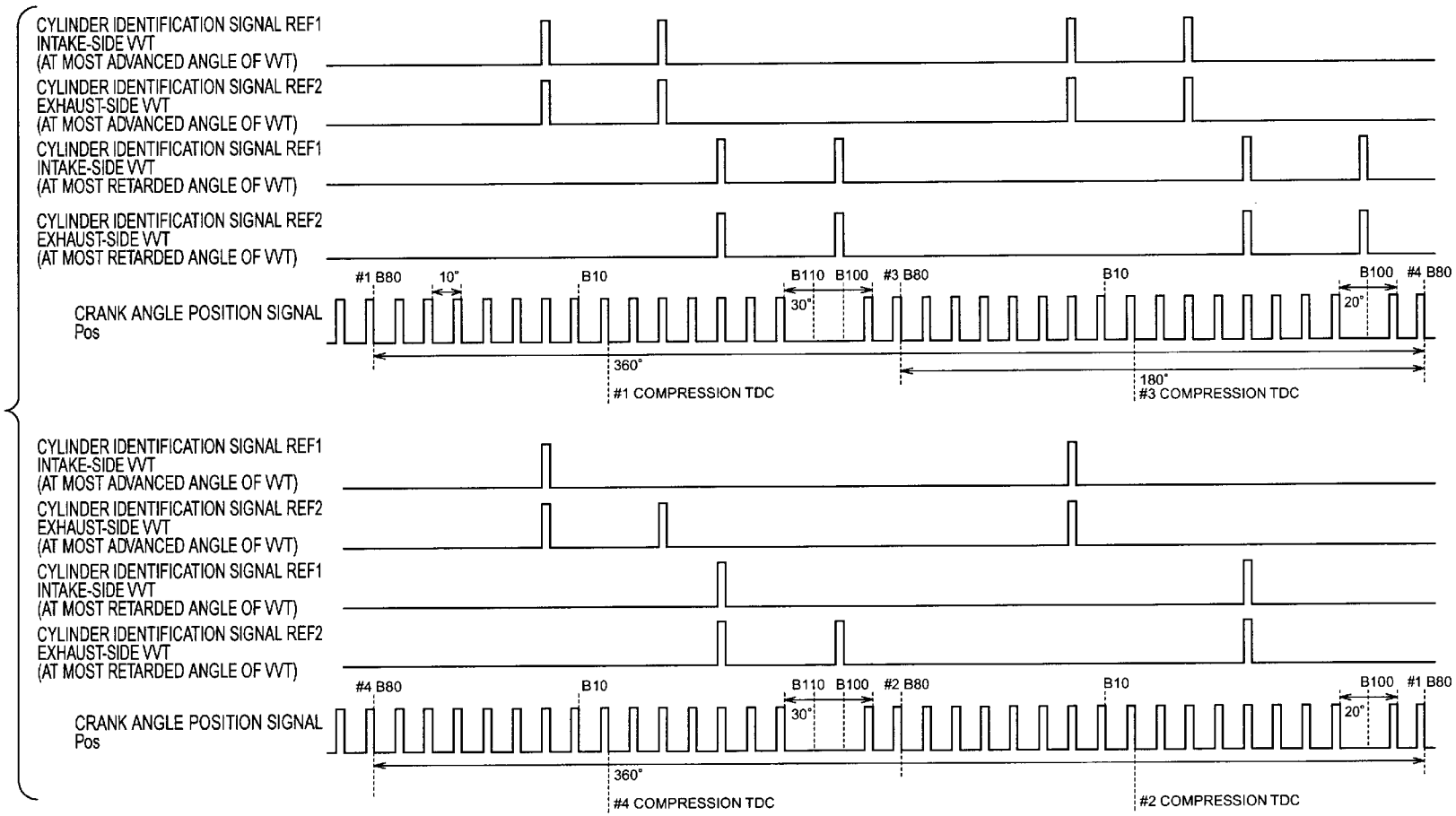
FIG. 5 is a flow chart illustrating the operation of the cylinder identification apparatus according to the first embodiment of the present invention.

FIG. 5 shows a pattern of the crank angle position signal Pos obtained from the first signal detector 81 of a four-cylinder engine equipped with such VVT mechanisms for the intake side and the exhaust side, as well as patterns of the cylinder identification signals Ref1 (intake side) and Ref2 (exhaust side) obtained from the second intake-side signal detector 82A and the second exhaust-side signal detector 82B. The reference cam angle patterns on the intake side and the exhaust side are identical with each other, and they are arranged in phase with each other. That is, the rotating disks 2 with the arrangement of projections as shown in FIG. 4B are used with the cams on the intake side and on the exhaust side, and they are arranged to be in phase with each other.

Figure 6:
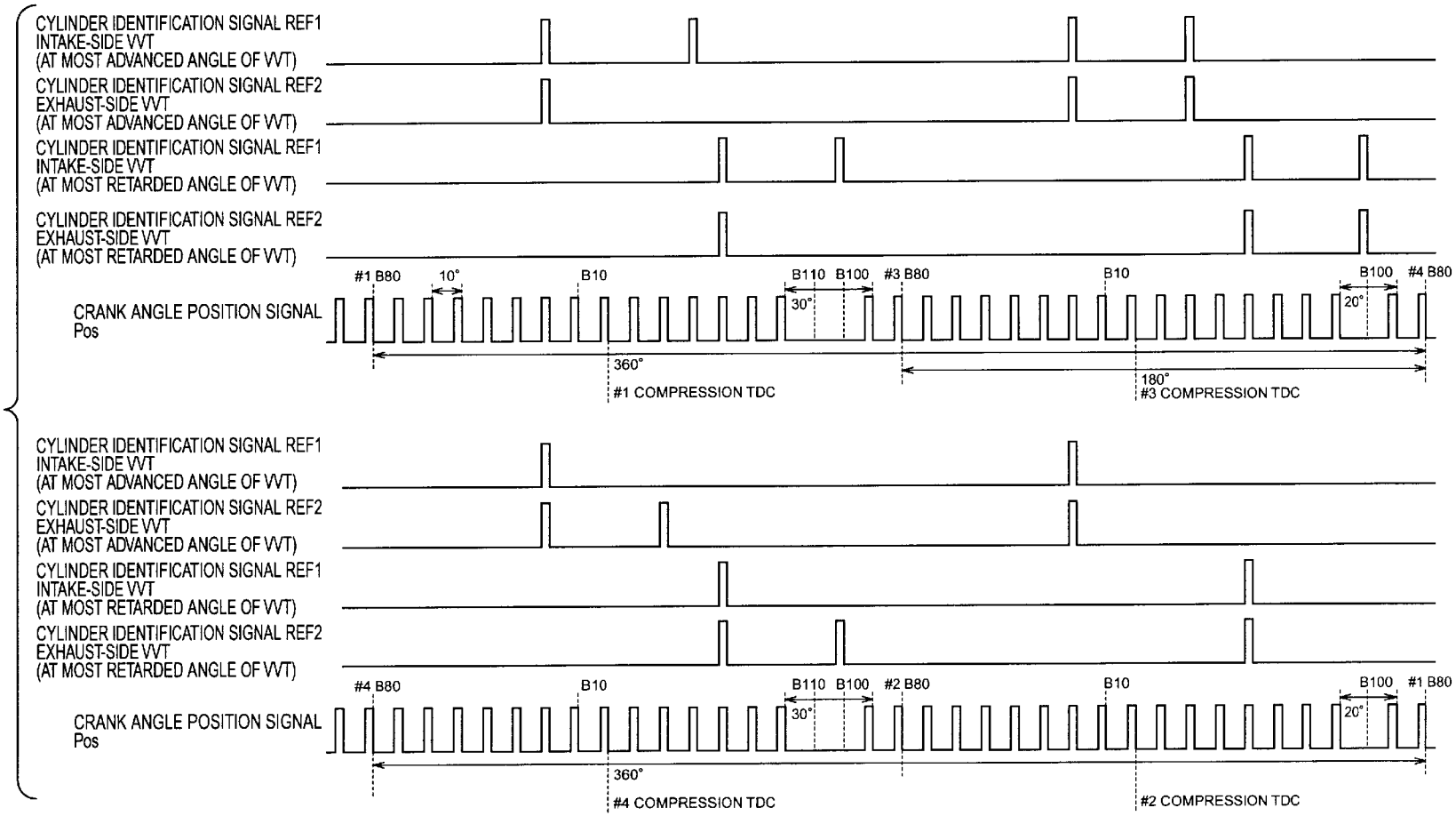
FIG. 6 is a flow chart illustrating the operation of the cylinder identification apparatus according to the first embodiment of the present invention.

Also, FIG. 6 shows patterns of the crank angle position signal Pos and the cylinder identification signals Ref1 (intake side) and Ref2 (exhaust side) obtained when the reference cam angle patterns on the intake side and the exhaust side are made identical with each other with the phases of the reference cam angles on the intake side and the exhaust side being shifted from each other. That is, two rotating disks 2 having the arrangement of the projections as shown in FIG. 4B are used with the intake-side and exhaust-side cams but arranged out of phase with respect to each other.

FIG. 5 and FIG. 6 are waveform diagrams in which five lower rows continue from corresponding five upper rows, respectively, and for the cylinder identification signals Ref1 and Ref2, a first row and a second row of both the five upper and five lower rows represent patterns of the most advanced angle of the VVT, and a third row and a fourth row represent patterns of the most retarded angle thereof (+60° CA (crank angle)).

The crank angle position signal Pos is generated at every 10° CA, and the one-tooth lost portion thereof is recognized as a B100° CA position (this meaning 100° from top dead center of B0° CA position that is the most compressed position of each cylinder), and the two-tooth lost portion thereof is recognized as B100° and B110° CA positions. From these lost tooth positions, B80° CA positions are identified or specified and assumed to be a reference crank angle position. The detection of these reference crank angle positions is carried out by the reference crank angle position detection means 201.

Moreover, the reference crank angle positions Pstd (B80° CA position) at four locations in total are specified by the number of lost teeth Nkake as follows.

The reference crank angle positions Pstd (B80° CA) corresponding to cylinders #1 and #4: the number of lost teeth Nkake=1

The reference crank angle positions Pstd (B80° CA) corresponding to cylinders #2 and #3: the number of lost teeth Nkake=2

The identification of these reference crank angle positions are carried out by the reference crank angle position identification means 203.

The cylinder identification ranges are usually set to be between adjacent or successive reference crank angle positions B80° CA (180° CA) by the number of detected pulses of the crank angle position signal Pos or by the detection of the reference crank angle positions. However, when a first reference crank angle position is detected upon engine starting, the cylinder identification ranges are set to be from 40° CA to 80° CA (140° CA: note, however, that counting is made in a direction of 40°→0°→170°→80°) in order to shorten the rotational angle required to identify the cylinders for earlier cylinder identification in consideration of the ordinary engine stop position. The setting of these cylinder identification ranges is performed by the cylinder identification range setting means 205.

The cylinder identification signals Ref1 and Ref2 are obtained from the projections 82*a* of the corresponding rotating disks 2, respectively, when the intake-side and the exhaust-side cams are driven to rotate. In consideration of a phase difference between the crankshaft 11*a* and the camshafts 1*a*, 1*b* including the VVT operation of the cams as well as the shortening of the cylinder identification ranges upon engine starting, the projections 82*a* are arranged in such a manner that a predetermined number of pulses of each of the cylinder identification signals Ref1 and Ref2 is generated within each cylinder identification range.

Specifically, in cases where two reference cam angle identical pattern outputs are in phase with each other, as shown in FIG. 5, the cylinder identification signals Ref1 and Ref2 are arranged as follows:

Between B40° CA of cylinder #1 and B80° CA of cylinder #3: the numbers of Ref pulses Nref21 and Nref22 of the intake-side and exhaust-side cylinder identification signals within the cylinder identification range are two (i.e., Nref21=2 and Nref22=2);

Between B40° CA of cylinder #3 and B80° CA of cylinder #4: the numbers of Ref pulses Nref21 and Nref22 of the intake-side and exhaust-side cylinder identification signals within the cylinder identification range are two (i.e., Nref21=2 and Nref22=2);

Between B40° CA of cylinder #4 and B80° CA of cylinder #2: the numbers of Ref pulses Nref21 and Nref22 of the intake-side and exhaust-side cylinder identification signals within the cylinder identification range are one (i.e., Nref21=1 and Nref22=1); and Between B40° CA of cylinder #2 and B80° CA of cylinder #1: the numbers of Ref pulses Nref21 and Nref22 of the intake-side and exhaust-side cylinder identification signals within the cylinder identification range are one (i.e., Nref21=1 and Nref22=1).

In this manner, when the intake-side cylinder identification signal Ref1 and the exhaust-side cylinder identification signal Ref2 are in phase with each other, Nref21 becomes equal to Nref22 and hence the kind or number of possible combinations of the number of Ref pulses of the intake-side cylinder identification signal Nref21 and that of the exhaust-side cylinder identification signal Nref22 becomes 2.

In addition, in cases where the two reference cam angle identical pattern outputs are out of phase from each other, as shown in FIG. 6, the intake-side and exhaust-side cylinder identification signals Ref1 and Ref2 are arranged as follows:

Between B40° CA of cylinder #1 and B80° CA of cylinder #3: the numbers of Ref pulses Nref21 and Nref22 of the intake-side and exhaust-side cylinder identification signals within the cylinder identification range are two and one, respectively (i.e., Nref21=2 and Nref22=1);

Between B40° CA of cylinder #3 and B80° CA of cylinder #4: the numbers of Ref pulses Nref21 and Nref22 of the intake-side and exhaust-side cylinder identification signals within the cylinder identification range are two (i.e., Nref21=2 and Nref22=2);

Between B40° CA of cylinder #4 and B80° CA of cylinder #2: the numbers of Ref pulses Nref21 and Nref22 of the intake-side and exhaust-side cylinder identification signals within the cylinder identification range are one and two, respectively (Nref21=1 and Nref22=2); and Between B40° CA of cylinder #2 and B80° CA of cylinder #1: the numbers of Ref pulses Nref21 and Nref22 of the intake-side and exhaust-side cylinder identification signals within the cylinder identification range are one (Nref21=1 and Nref22=1).

From the above, it can be seen that when the cylinder identification ranges are set between adjacent or successive reference crank angle positions Pstd, cylinder identification (i.e., the identification of the cylinders) becomes possible by the combinations of the reference crank angle positions Pstd identified or specified by the number of lost teeth Nkake and the numbers of Ref pulses of the cylinder identification signals (Nref21, Nref22). The identification of the cylinders is carried out by the cylinder identification means 207.

The results of the determinations according to the combinations of the number of lost teeth Nkake, the number of intake-side Ref pulses Nref21 and the number of exhaust-side Ref pulses Nref22 of the cylinder identification signals are shown in Table 1 below when the two reference cam angle identical pattern outputs are in phase with each other, and in Table 2 below when the two reference cam angle identical pattern outputs are out of phase from each other.

Moreover, since sufficient cylinder identification ranges are set even if the intake-side and exhaust-side cylinder identification signals Ref1 or Ref2 are displaced or shifted to an ignition-advancing angle side by an angle of 50° CA or so for instance according to the VVT control operation (though this being not frequent), it is possible to detect these signals Ref1 and Ref2 in a reliable manner, thus enabling accurate cylinder identification.

TABLE 1

(In case of the two reference crank angle identical pattern outputs being in phase with each other)

| Cylinder identification results (B80° CA position) | Number of lost teeth (Nkake) at reference crank angle position Pstd | Within cylinder identification ranges Number of Ref pulses of cylinder identification signal (intake side Nref21 = exhaust side Nref22) |
|---|---|---|
| Cylinder #1 | 1 | 1 |
| Cylinder #3 | 2 | 2 |
| Cylinder #4 | 1 | 2 |
| Cylinder #2 | 2 | 1 |

TABLE 2

(In case of the two reference crank angle identical pattern outputs being out of phase from each other)

| Cylinder identification results (B80° CA position) | Number of lost teeth (Nkake) at reference crank angle position Pstd | Within cylinder identification ranges: Number of Ref pulses of intake-side cylinder identification signal Nref21 | Within cylinder identification ranges: Number of Ref pulses of exhaust-side cylinder identification signal Nref22 |
|---|---|---|---|
| Cylinder #1 | 1 | 1 | 1 |
| Cylinder #3 | 2 | 2 | 1 |
| Cylinder #4 | 1 | 2 | 2 |
| Cylinder #2 | 2 | 1 | 2 |

TABLE 3

(In case of a combination of the intake-side cylinder identification signal and the reference crank angle position)

| Cylinder identification results (B80° CA position) | Number of lost teeth (Nkake) at reference crank angle position Pstd | Within cylinder identification ranges Number of Ref pulses of intake-side cylinder identification signal Nref21 |
|---|---|---|
| Cylinder #1 | 1 | 1 |
| Cylinder #3 | 2 | 2 |
| Cylinder #4 | 1 | 2 |
| Cylinder #2 | 2 | 1 |

TABLE 4

(In case of a combination of the exhaust-side cylinder identification signal and the reference crank angle position)

| Cylinder identification results (B80° CA position) | Number of lost teeth (Nkake) at reference crank angle position Pstd | Within cylinder identification ranges Number of Ref pulses of exhaust-side cylinder identification signal Nref22 |
|---|---|---|
| Cylinder #1 | 1 | 1 |
| Cylinder #3 | 2 | 1 |
| Cylinder #4 | 1 | 2 |
| Cylinder #2 | 2 | 2 |

In addition, as shown in Table 3 and Table 4 above, it is possible to perform cylinder identification according to the combination of either one of the cylinder identification signals Ref1 and Ref2 with the reference crank angle position Pstd. Although the intake-side cylinder identification signal Ref1 is used for ordinary cylinder identification (in this case, a determination being made according to Table 3), the exhaust-side cylinder identification signal Ref2 may instead be used for this purpose (in this case, a determination being made according to Table 4). In this case, cylinder identification is carried out based on the flow chart of FIG. 7.

Figure 7:
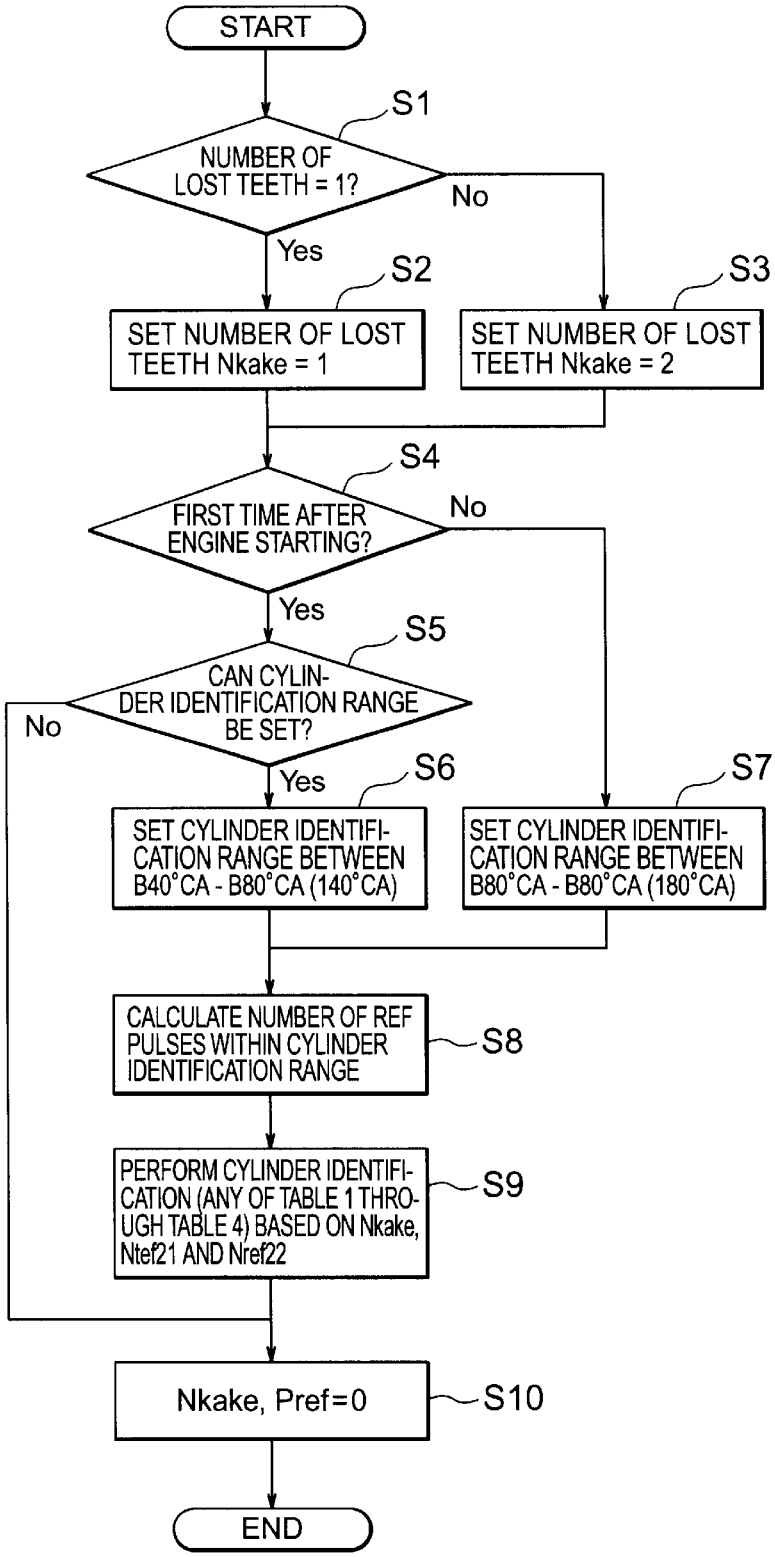
FIG. 7 is a flow chart illustrating the operation of the cylinder identification apparatus according to the first embodiment of the present invention.

FIG. 7 illustrates the respective determination methods according to Tables 1 through 4 while bringing them into combination with each other to form a single flow chart. Briefly explaining this flow chart, first of all, the number of lost teeth Nkake is obtained (steps S1–S3), and then it is determined whether this is a first time after engine starting (step S4). If so, it is further determined or confirmed whether a cylinder identification range can be set (step S5), and if the setting is possible, a cylinder identification range of 140° CA is then set (step S6). On the other hand, if it is determined in step S4 that this is not the first time after engine starting, then a range of 180° CA is set (step S7). Thereafter, the number of Ref pulses of at least one of the cylinder identification signals Nref21 or Nref22 in each cylinder identification range thus set is calculated (step S8). Then, cylinder identification (i.e., the identification of the cylinders) is performed based on a combination of the reference crank angle position Pstd specified by the number of lost teeth Nkake and the calculated number of Ref pulses of at least one of the cylinder identification signals Nref21 or Nref22 according to any of Tables 1 through 4 (step S9). Thereafter, the number of lost teeth Nkake and the numbers of Ref pulses of the cylinder identification signals (Nref21, Nref22) are reset to zero (step S10).

Here, note that in step S8, both Nref21 and Nref22 are usually calculated as the numbers of Ref pulses of the cylinder identification signals, but when the two reference cam angle identical pattern outputs shown in FIG. 5 are in phase with each other, either one of Nref21 and Nref22 alone may be calculated. In addition, when Table 3 is used, Nref21 is calculated, whereas when Table 4 is used, Nref22 is calculated.

Thus, in the cylinder identification, either one of the cylinder identification signals Ref1 and Ref2 (or the numbers of pulses thereof Nref21 and Nref22) may be used by the above-mentioned cylinder identification means 207, and the number of Ref pulses of the other cylinder identification signal may be used as a fail safe signal for detecting a failure of cam sensors (second intake-side and exhaust-side signal detectors 82A and 82B). In this manner, the fail safe capability of the cylinder identification can be improved. The following advantages are obtained by using two cylinder identification signals.

Firstly, the load of S/W (software) can be reduced since a variety of timing processing methods can be employed for determination or confirmation of signal failure or abnormality. For instance, because there are two cylinder identification signals, it is possible to determine or confirm whether either one of the cylinder identification signals is out of order, merely by making a comparison between the results of the cylinder identifications based on the respective signals. Therefore, it becomes no longer necessary to use complicated detection logics.

Secondly, in the cylinder identification ranges, a failure of the cam sensors is determined by measuring the number of Ref pulses Nref21 or Nref22 of each of the cylinder identification signals Ref1 and Ref2, thus making it possible to perform fail safe processing (i.e., switching from a failed or abnormal one to the other normal one of the cylinder identification signals). Since, however, an error in the counting of signal pulses might be caused due to noise or the like, a failure determination method is such that when an event of Nref21>2 or Nref21=0 has taken place a plurality of times (e.g., two times in succession) within one cycle or period (e.g., 720° CA) in which all the cylinders are identified, it is determined that one of the cam sensors has failed, so fail safe processing is carried out. That is, in cases where the correct or normal intake-side cylinder identification signal Ref1 is not able to be obtained due to a failure of the intake-side cam sensor or the like (e.g., when the signal Ref1 is always at a constant level, or when an error in counting takes place due to the generation of abnormality in the signal Ref1, etc.), it is possible to perform cylinder identification by switching, as fail safe processing, the cylinder identification signal used in combination with the crank angle position signal from the intake-side cylinder identification signal Ref1 into the exhaust-side cylinder identification signal Ref2 in the form of a backup signal. Similarly, when in cases where the correct or normal exhaust-side cylinder identification signal Ref2 is not able to be obtained due to a failure of the exhaust-side cam sensor or the like (e.g., when the signal Ref2 is always at a constant level, or when an error in counting takes place due to the generation of abnormality in the signal Ref2, etc.), it is possible to perform cylinder identification by switching, as fail safe processing, the cylinder identification signal used in combination with the crank angle position signal from the exhaust-side cylinder identification signal Ref2 into the intake-side cylinder identification signal Ref1 in the form of a backup signal.

Thirdly, if there is a difference between the result of the cylinder identification according to the combination of the crank angle position signal with the intake-side cylinder identification signal Ref1 and the result of the cylinder identification according to the combination the crank angle position signal with the exhaust-side cylinder identification signal Ref2, a determination as to which of the signals Ref1 and Ref2 is abnormal can be made so as to enable fail safe processing, for example, by predicting the current numbers of Ref pulses of the cylinder identification signals Ref1 and Ref2 from the last numbers of Ref pulses thereof stored in the memory 211. Specifically, for instance, when the current cylinder identification result is that Nkake=1, Nref21=1 and Nref22=2, the cylinder being currently identified becomes cylinder #1 from the condition of Nkake=1 and Nref21=1 in Table 3, but it becomes cylinder #4 from the condition of Nkake=1 and Nref22=2 in Table 4. Thus, there is disagreement between the cylinder identification result from Table 3 and that from Table 4.

In this case, if it is determined as Nref21[n−1]=1 and Nref22[n−1]=2 from the last number of Ref pulses of the intake-side cylinder identification signal Nref21 [n−1] and the last number of Ref pulses of the exhaust-side cylinder identification signal Nref22[n−1], a prediction will be able to be made from Table 2 that the last identified cylinder is cylinder #2, and hence the current cylinder can be expected to be cylinder #1. Therefore, proper or correct cylinder identification can be made by using the intake-side cylinder identification signal Ref1 as a cylinder identification signal. The above-mentioned cylinder identification method is performed based on the flow charts of FIGS. 8 through 11.

Figure 8:
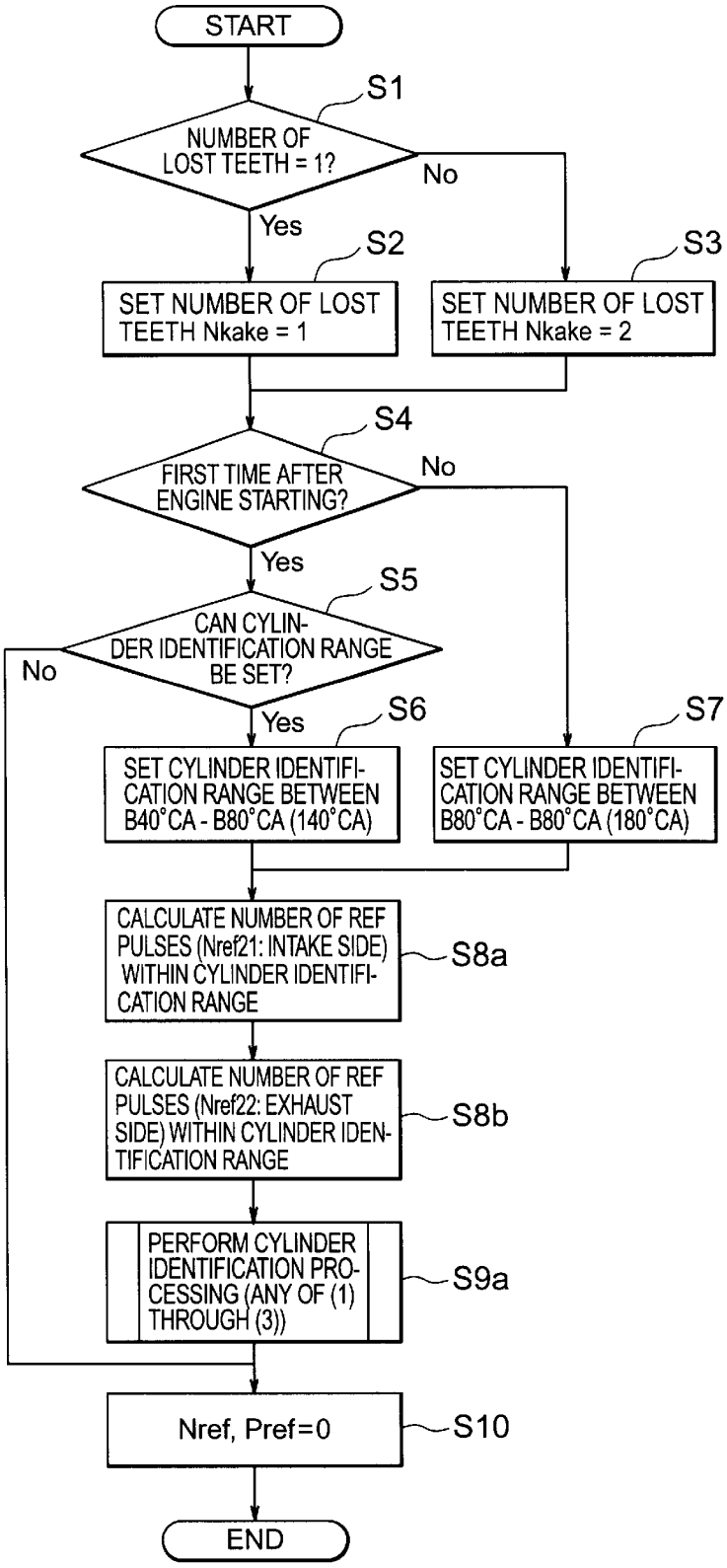
FIG. 8 is a flow chart illustrating the operation of the cylinder identification apparatus according to the first embodiment of the present invention.
Figure 9:
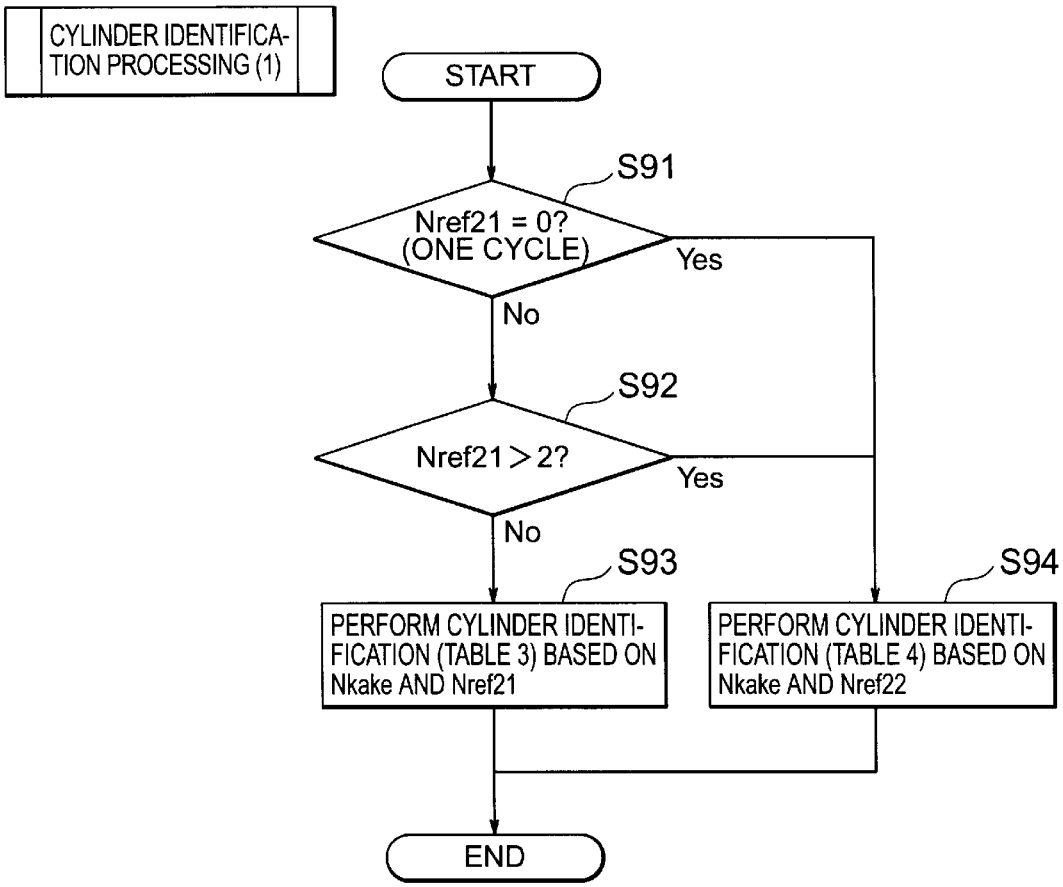
FIG. 9 is a flow chart for explaining one example of the operation of cylinder identification processing of FIG. 8.
Figure 10:
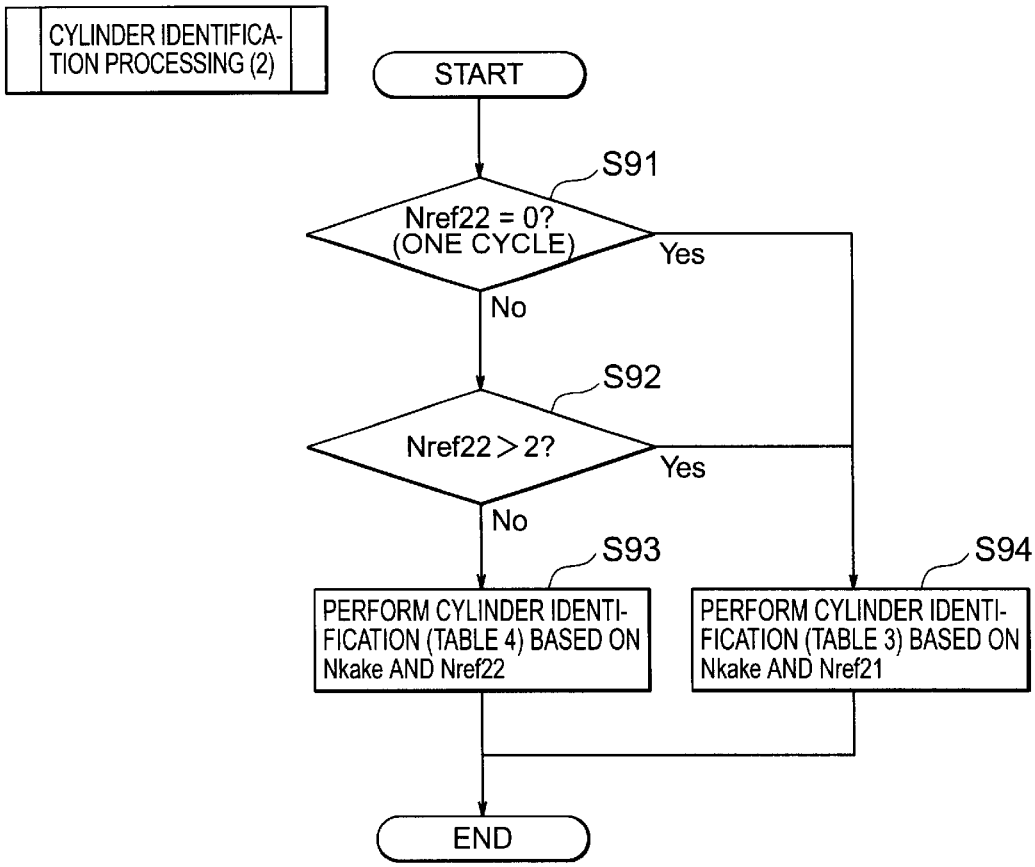
FIG. 10 is a flow chart for explaining another example of the operation of cylinder identification processing of FIG. 8.
Figure 11:
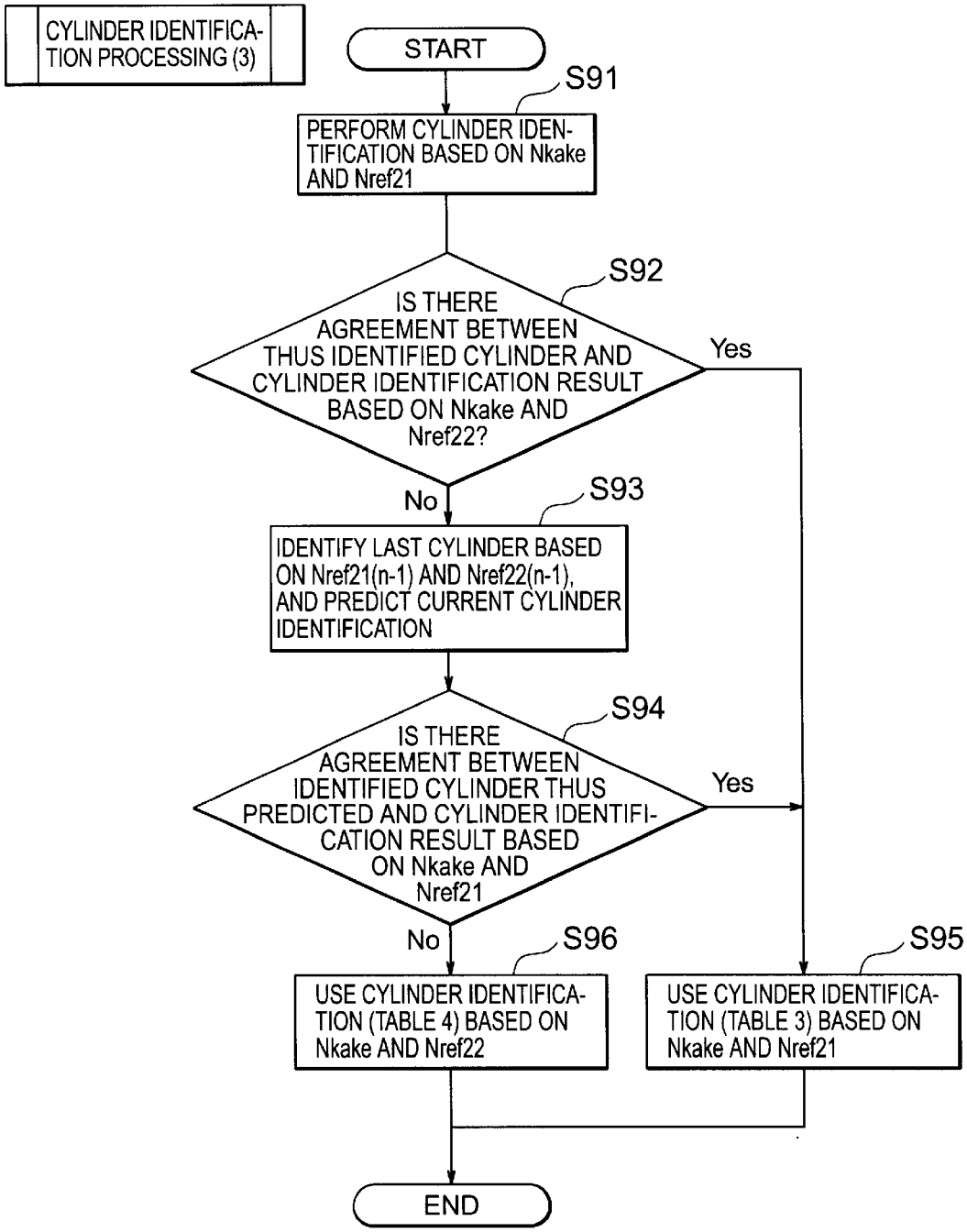
FIG. 11 is a flow chart for explaining a further example of the operation of cylinder identification processing of FIG. 8.

FIG. 8 shows the above-mentioned cylinder identification method including fail safe processing as a flow chart. Briefly explaining the flow chart of FIG. 8, steps S1 through S7 correspond to the aforementioned steps S1 through S7 in FIG. 7, respectively. In step S8*a*, the number of Ref pulses of the intake-side cylinder identification signal (Nref21) within the current cylinder identification range is calculated, and in step S8*b*, the number of Ref pulses of the exhaust-side cylinder identification signal (Nref22) within the current cylinder identification range is calculated. Then in step S9*a*, either of the cylinder identification processing (1)-(3) shown in FIGS. 9 through 11 is performed. In step S10, the number of lost teeth Nkake and the numbers of Ref pulses of the cylinder identification signals (Nref21, Nref22) are reset to zero.

In cylinder specific processing (1) of FIG. 9, by determining whether the number of pulses of the intake-side cylinder identification signal Nref21 within one cycle or period is zero or not more than two (three or more), it is confirmed that this cylinder identification signal is normal (steps S91 and S92). If normal, then cylinder identification is carried out according to the number of lost teeth Nkake and the number of Ref pulses Nref21 of the intake-side cylinder identification signal based on Table 3 (step S93), whereas if abnormal, cylinder identification is carried out according to the number of lost teeth Nkake and the number of Ref pulses Nref22 of the exhaust-side cylinder identification signal based on Table 4 (step S94).

In addition, in cylinder specific processing (2) of FIG. 10, by determining whether the number of pulses of the exhaust-side cylinder identification signal Nref22 within one cycle or period is zero or not more than two (three or more), it is confirmed whether this cylinder identification signal is normal (steps S91 and S92). If normal, cylinder identification is carried out according to the number of lost teeth Nkake and the number of Ref pulses Nref22 of the exhaust-side cylinder identification signal based on Table 4 (step S93), whereas if abnormal, then cylinder identification is carried out according to the number of lost teeth Nkake and the number of Ref pulses Nref21 of the intake-side cylinder identification signal based on Table 3 (step S94).

Moreover, in cylinder specific processing (3) of FIG. 11, first of all, cylinder identification according to Nkake and Nref21 is carried out (step S91), and it is then confirmed whether the cylinder identified by this cylinder identification is in agreement with the cylinder identification result according to Nkake and Nref22 (step S92). If not in agreement, the identification of the last cylinder is carried out according to Nref21(n−1) and Nref22(n−1) stored in the memory 211 for instance, and the current cylinder is predicted from the result of this identification (step S93). Then it is confirmed whether the cylinder thus identified in step S93 and the cylinder identified according to Nkake and Nref21 are in agreement with each other (step S94). Subsequently, if the respective identified cylinders are in agreement with each other in steps S92 and S94, that is, if the number of Ref pulses Nref21 of the intake-side cylinder identification signal is normal, cylinder identification is carried out according to the number of lost teeth Nkake and the number of Ref pulses Nref21 of the intake-side cylinder identification signal based on Table 3 (step S95). On the other hand, if it is determined in step S94 that there is disagreement between the identified cylinders, that is, if the number of pulses Nref21 of the intake-side cylinder identification signal is abnormal, cylinder identification is carried out according to the number of lost teeth Nkake and the number of Ref pulses Nref22 of the exhaust-side cylinder identification signal based on Table 4 (step S96).

In addition, in FIG. 11, according mainly to the number of pulses Nref21 of the intake-side cylinder identification signal, it is determined whether the intake-side cylinder identification signal is normal or abnormal, based on which an appropriate cylinder identification method has been selected, but it may instead be determined according mainly to the number of pulses Nref22 of the exhaust-side cylinder identification signal whether the exhaust-side cylinder identification signal is normal or abnormal, based on which an appropriate cylinder identification method may be selected. In that case, Nref21 and Nref22 are reversed in steps S91, S92 and S94, and step S95 is exchanged with step S96.

Embodiment 2

In the above-mentioned embodiment, it has been described that assuming that the number of lost teeth Nkake at a reference crank angle position Pstd is (A), the number of Ref pulses Nref21 of the intake-side cylinder identification signal is (B), and the number of Ref pulses Nref22 of the exhaust-side cylinder identification signal is (C), as shown in Table 2, it is possible to perform cylinder identification by using a combination of (A) and (B) or (A) and (C). However, it is also possible to perform cylinder identification by the use of a combination of (B) and (C) other than the above-mentioned combinations, in which there are employed only two reference cam angle patterns which are out of phase from each other, as shown in FIG. 6.

Thus, correct cylinder identification can be performed even when the number of lost teeth Nkake is always at a constant level (Nkake=0) or becomes an error count (Nkake>2). Accordingly, even if either one of the three signals (A), (B) and (C) becomes abnormal, it is possible to carry out cylinder identification according to a combination of the other two signals.

Figure 12:
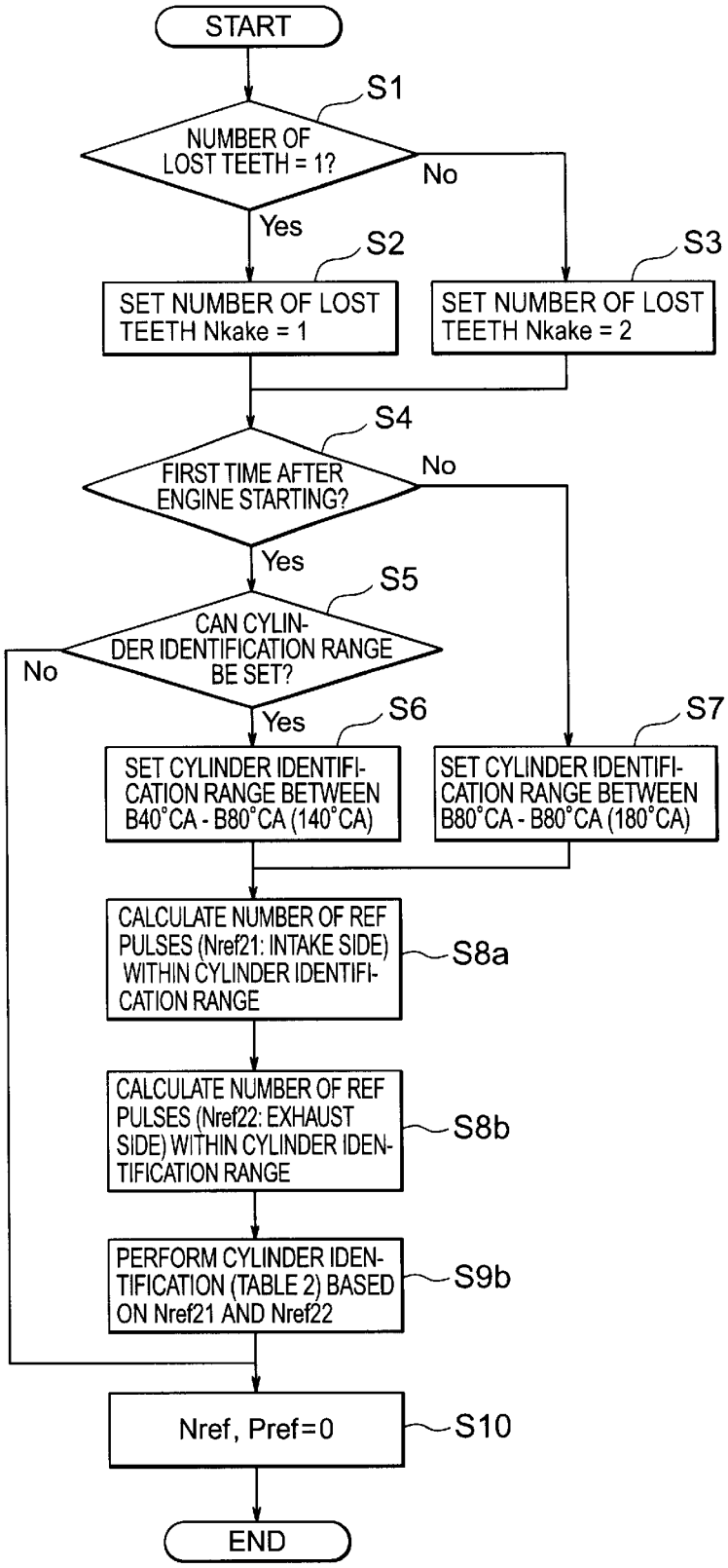
FIG. 12 is a flow chart illustrating the operation of a cylinder identification apparatus according to a second embodiment of the present invention.

For instance, even if Nref21=0 (constant level), cylinder identification can be made according to a combination of signals of Nkake and Nref22. In addition, even if Nref21>2, cylinder identification can also be made according to a similar combination. Similarly, when Nref22 is abnormal, cylinder identification can be made according to a combination of signals of Nkake and Nref21, whereas when Nkake is abnormal, cylinder identification can be made according to a combination of signals of Nref21 and Nref22. The method of performing cylinder identification according to the combination of signals of Nref21 and Nref22 when Nkake is abnormal is shown in the flow chart of FIG. 12. The flow chart of FIG. 12 is basically the same as the flow chart of FIG. 8 excepting that cylinder identification is carried out according to Nref21 and Nref22 based on Table 2 in step S9*b*.

Embodiment 3

Although in the above-mentioned embodiments, the cylinder identification methods using two signals have been described, the following method may be employed as a cylinder identification method using three signals when there has taken place an error count (i.e., in the range of 1 or 2) due to noise or the like. The current cylinder can be predicted based on the estimation of the last cylinder and the last-but-one cylinder by storing in the memory 211 data (historical data) including the current number of intake-side Ref pulses Nref21, the last number of intake-side Ref pulses Nref21[n−1], the last-but-one number of intake-side Ref pulses Nref21[n−2], the current number of exhaust-side Ref pulses Nref22, the last number of exhaust-side Ref pulses Nref22[n−1], the last-but-one number of exhaust-side Ref pulses Nref22[n−2].

For instance, when the current cylinder identification result is Nkake=1, Nref21=1 and Nref22=2 (if Nref22=1, the current cylinder being cylinder #1), it is determined that this result is an error since it is not in agreement with any cylinder identification result in Table 2. Thus, the data of the last three values and the last-but-one three values as described above are confirmed. When these pieces of data are Nref21[n−1]=1, Nref21[n−2]=2, Nref22[n−1]=2 and Nref22[n−2]=2, it can be estimated that the last identified cylinder is cylinder #2 and the last-but-one identified cylinder is cylinder #4. As a result, it can be predicted that the current identified cylinder is cylinder #1, and hence it is found that Nref22 is abnormal. Even in case of Nref22=1 instead of Nref22=2 in the current cylinder identification result as described above, it is possible to perform cylinder identification according to similar methods. These cylinder identification methods are shown in the flow charts of FIGS. 13 through 15.

Figure 13:
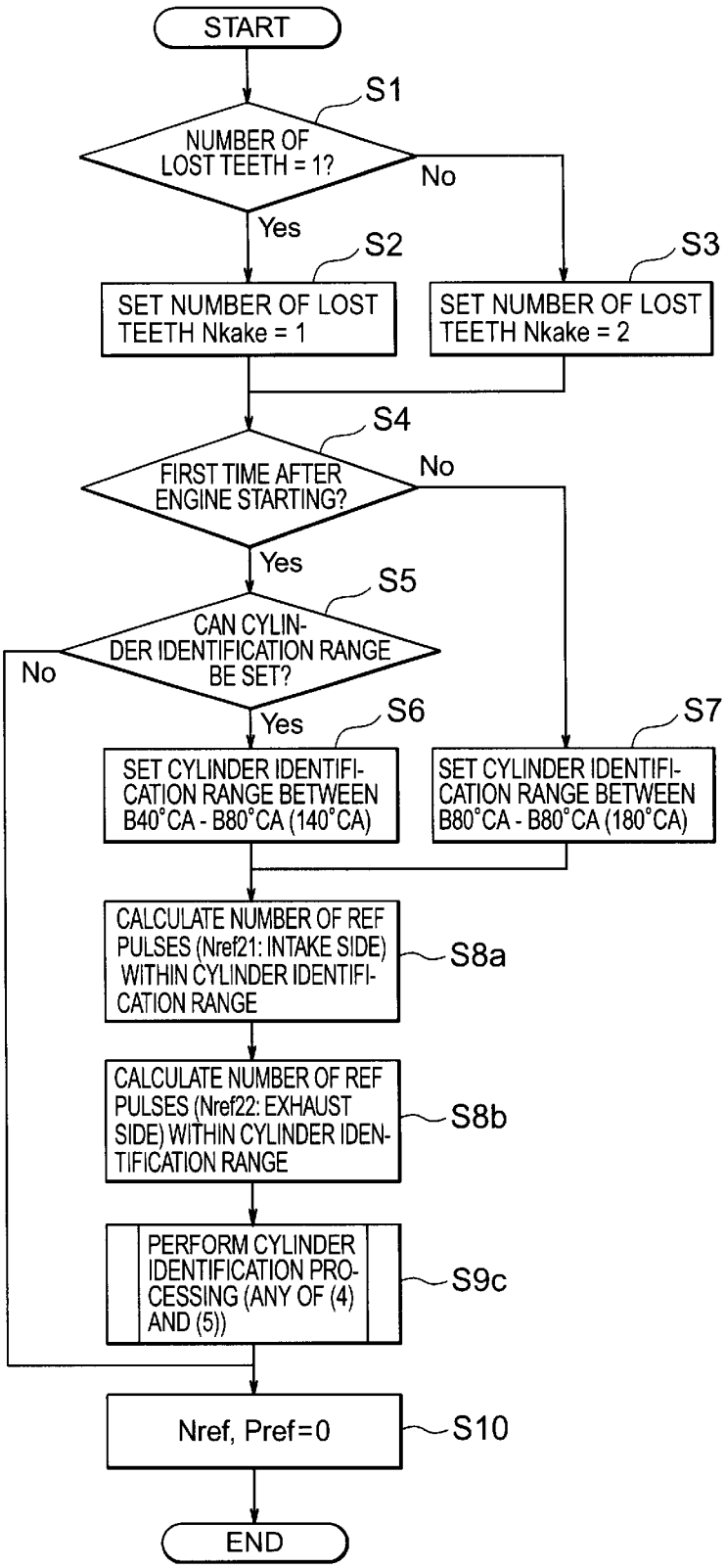
FIG. 13 is a flow chart illustrating the operation of a cylinder identification apparatus according to a third embodiment of the present invention.

The flow chart of FIG. 13 is basically the same as the flow charts of FIG. 8 and FIG. 12 excluding cylinder identification processing in step S9*c*. In the cylinder identification processing in step S9*c*, cylinder identification processing (4) or cylinder identification processing (5) shown in FIG. 14 or FIG. 15, respectively, is performed.

Figure 14:
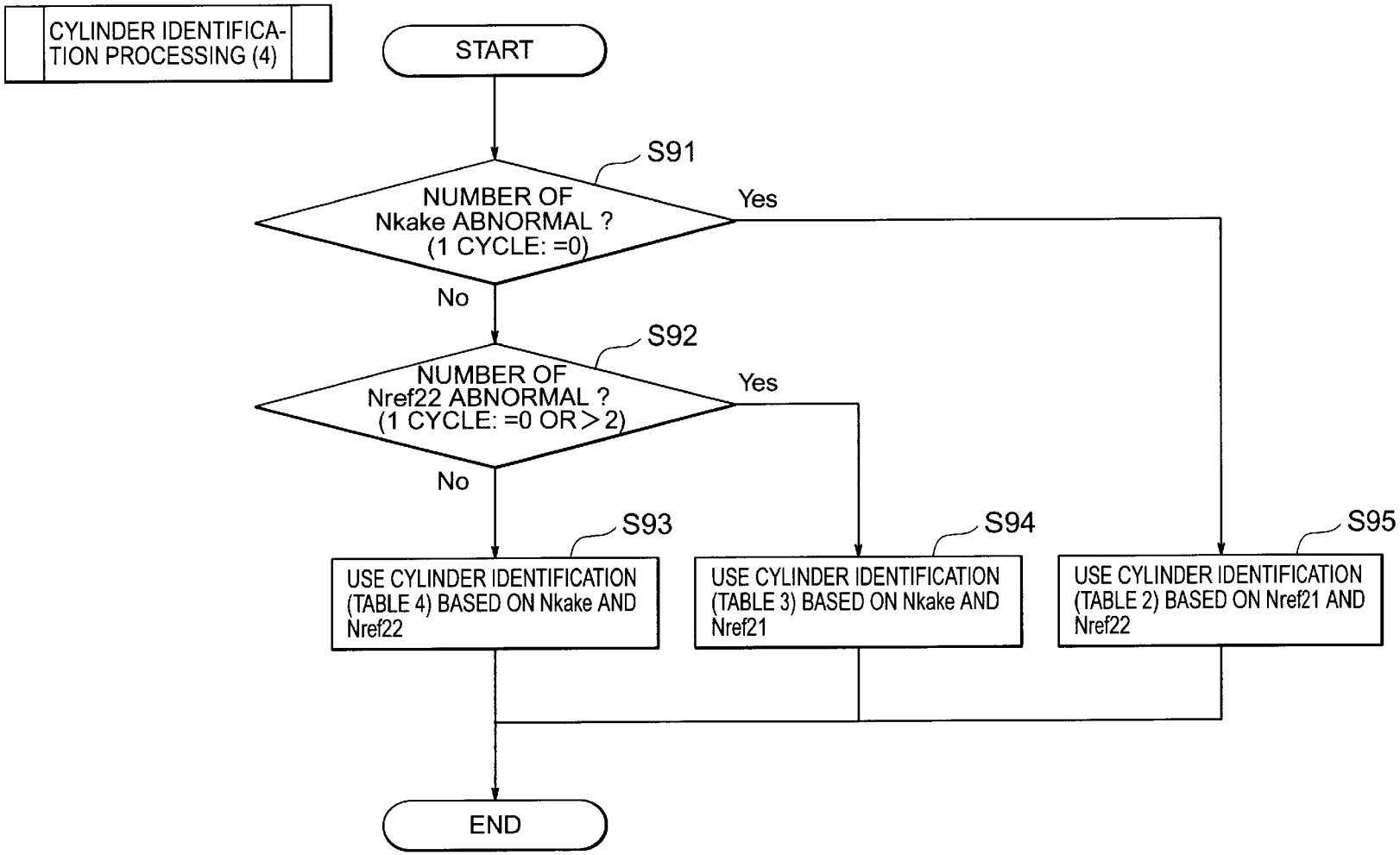
FIG. 14 is a flow chart for explaining one example of the operation of cylinder identification processing of FIG. 13.

In the cylinder identification processing (4) of FIG. 14, if it is determined that the number of lost teeth Nkake is abnormal because Nkake is zero over one cycle or period for instance (step S91), the cylinder identification according to Nref21 and Nref22 is performed based on Table 2 (step S95). In addition, if it is determined that the exhaust-side cylinder identification signal Ref2 is abnormal because Nref22 is zero or larger than two (three or more) over one cycle or period for instance (step S92), the cylinder identification according to Nkake and Nref21 is performed based on Table 3 (step S94). Moreover, when both Nkake and Nref22 are normal, the cylinder identification according to Nkake and Nref22 is performed based on Table 4 (step S93).

Figure 15:
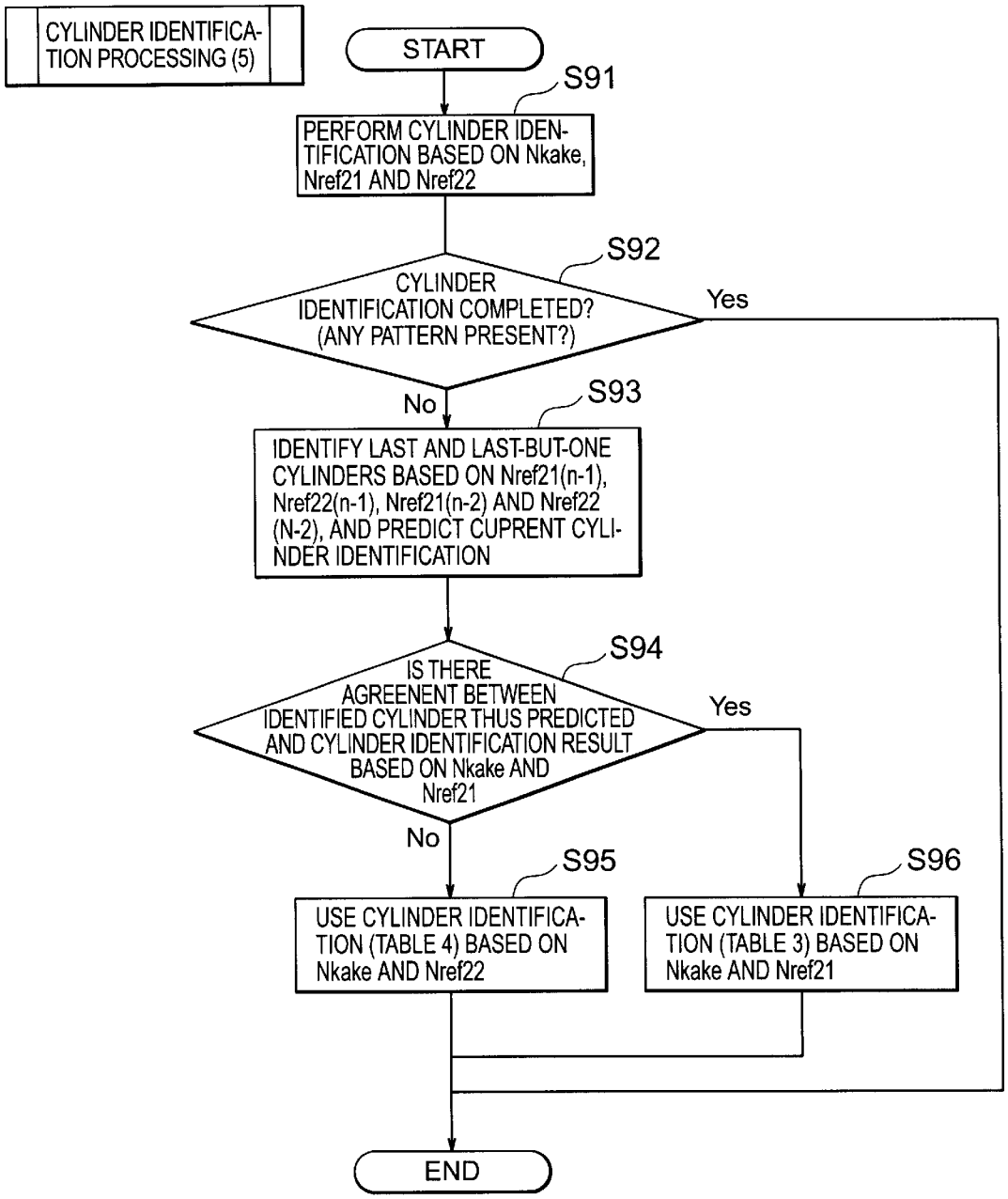
FIG. 15 is a flow chart for explaining another example of the operation of cylinder identification processing of FIG. 13.
Figure 16:
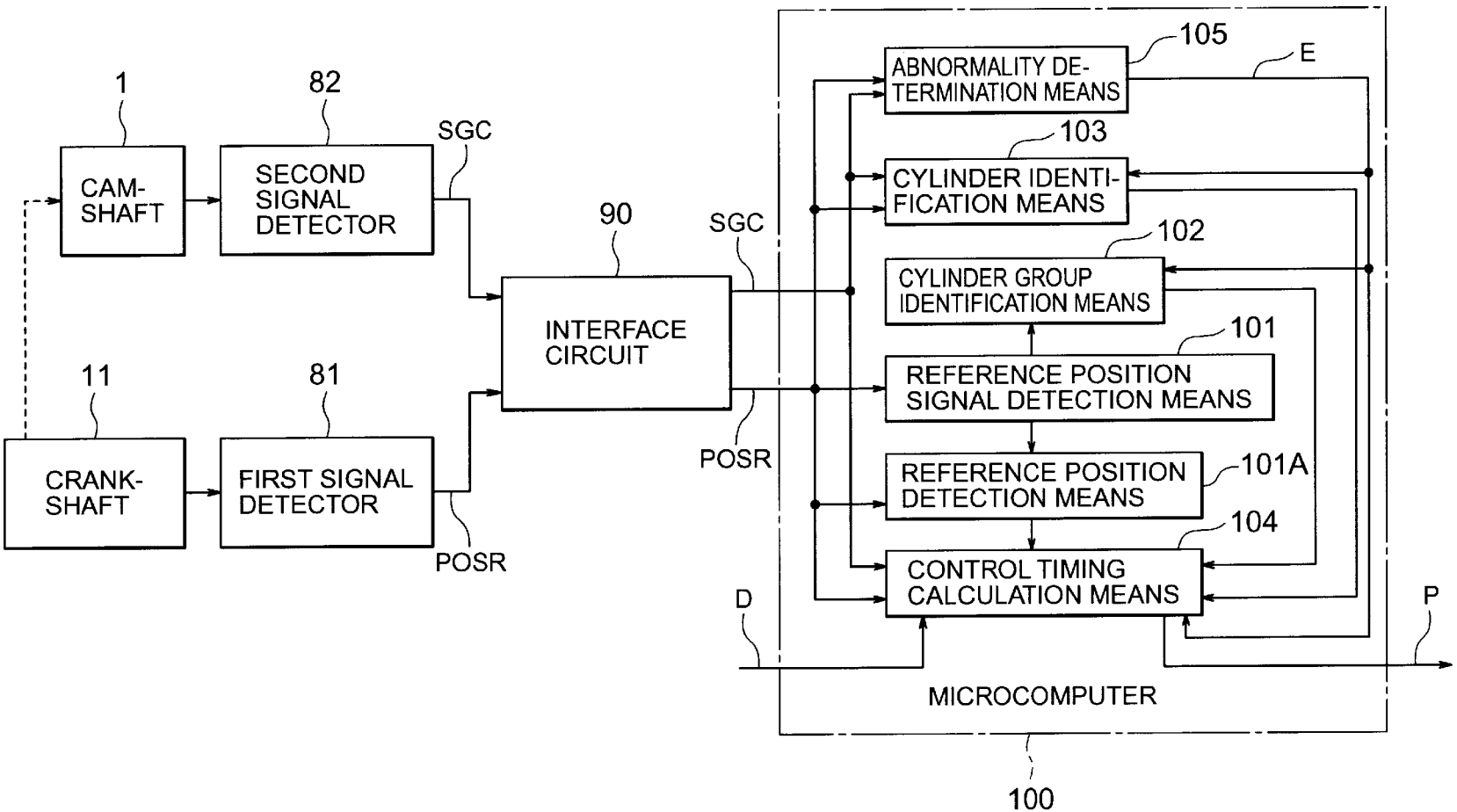
FIG. 16 is a view illustrating the configuration of this kind of conventional cylinder identification apparatus for an internal combustion engine.

In the cylinder identification processing (5) of FIG. 15, cylinder identification is performed by using three kinds of signals comprising the number of lost teeth Nkake, the number of intake-side Ref pulses Nref21, and the number of exhaust-side Ref pulses Nref22 (step S91). For instance, if cylinder identification cannot be done since there is no combination (pattern) that corresponds to any combination of the above-mentioned three kinds of signals obtained in the tables (Tables 1 through 4) (step S92), the last cylinder and the last-but-one cylinder are specified based on Nref21[n−1], Nref22[n−1], Nref21[n−2] and Nref22[n−2], and then the current cylinder identification is predicted based on the last and the last-but-one cylinders thus specified (step S93).

Thus, if the cylinder identification result according to Nkake and Nref21 is in agreement with the current cylinder predicted from the last specified cylinder and the last-but-one specified cylinder for instance (step S94), cylinder identification according to Nkake and Nref21 is performed based on Table 3 (step S96), whereas if there is no agreement between them, cylinder identification according to Nkake and Nref22 is performed based on Table 4 (step S95).

As can be seen from the foregoing description, the present invention provides the following excellent advantages.

According to the present invention, there is provided a cylinder identification apparatus for a VVT controlled internal combustion engine which comprises: crank angle position signal generation means for generating a crank angle position signal including a train of pulses corresponding to rotational angles of a crankshaft of the internal combustion engine and specific signal pulses which are used to obtain a plurality of reference crank angle positions of respective cylinders of the internal combustion engine; and cylinder identification signal generation means for generating a cylinder identification signal including a train of pulses corresponding to the respective cylinders in accordance with the rotation of at least one of an intake-side cam and an exhaust-side cam which are caused to rotate at a ratio of ½ with respect to the rotational speed of the crankshaft and move to an advance angle position or a retard angle position under variable valve timing (VVT) control. The apparatus further comprises: reference crank angle position detection means for detecting the plurality of reference crank angle positions based on the specific signal pulse positions of the crank angle position signal; reference crank angle position identification means for identifying correlation between the plurality of reference crank angle positions and cylinder groups based on a combination of the plurality of reference crank angle positions and the cylinder identification signal; cylinder identification range setting means for setting cylinder identification ranges of a prescribed angular length with each of the reference crank angle positions as a reference in consideration of an advance angle and a retard angle according to the VVT control; and cylinder identification means for identifying the cylinders based on the reference crank angle positions whose correlation with the cylinder groups within each of the cylinder identification ranges is specified and the cylinder identification signal. With the above arrangement, it is possible to provide the cylinder identification apparatus which is applicable to a VVT controlled internal combustion engine without complicating the processing of combining the signals upon cylinder identification. That is, cylinder identification ranges and signals are set in consideration of valve operation angles (e.g., intake valve operation angle and/or exhaust valve operation angle) so that cylinder identification can be performed irrespective of the valve operation angles.

Preferably, the cylinder identification signal generation means generates two cylinder identification signals each corresponding to the cylinders of the internal combustion engine in accordance with the rotations of the intake-side and exhaust-side cams, respectively, the cylinder identification signals having same reference cam angle patterns arranged in phase with each other. Thus, it is possible to carry out cylinder identification in an easy and accurate manner without increasing the manufacturing cost of the apparatus.

Preferably, the cylinder identification signal generation means generates two cylinder identification signals each corresponding to the cylinders of the internal combustion engine in accordance with the rotations of the intake-side and exhaust-side cams, respectively, the cylinder identification signals having same reference cam angle patterns arranged out of phase from each other. Accordingly, cylinder identification can be performed in an easy and accurate manner without increasing the manufacturing cost of the apparatus.

Preferably, the cylinder identification apparatus further comprises fail safe processing means for using one of the two cylinder identification signals generated by the cylinder identification signal generation means as a fail safe signal, the other of the two cylinder identification signals being used by the cylinder identification means. Thus, it is possible to detect abnormality of the signal generation means or the like for example.

Preferably, the fail safe processing means uses the one of the cylinder identification signals for the purposes of normality confirmation thereof and a backup operation. Thus, a fail safe function and a backup function of the apparatus can be improved.

Preferably, the cylinder identification means identifies the cylinders based on the two intake-side and exhaust-side cylinder identification signals generated by the cylinder identification signal generation means in the cylinder identification ranges. Thus, an amount of information of each signal (or kinds of signals) can be reduced, thereby simplifying the system as a whole.

Preferably, the cylinder identification apparatus further comprises fail safe processing means for confirming normality of three kinds of signals including the crank angle position signal and the two cylinder identification signals. When either one of the three signals becomes abnormal, the cylinder identification means identifies the cylinders according to a combination of the other two signals Thus, the backup function can be improved.

Preferably, the cylinder identification apparatus further comprises a memory for storing the history of at least one of three kinds of signals including the crank angle position signal and the two cylinder identification signals. The fail safe processing means confirms normality of the signals from the history of the at least one signal thus stored. Thus, the reliability of the apparatus can be improved.

While the invention has been described in terms of preferred embodiments, those skilled in the art will recognize that the invention can be practiced with modifications within the spirit and scope of the appended claims.

What is claimed is:

1. A cylinder identification apparatus for a VVT controlled internal combustion engine comprising:

crank angle position signal generation means for generating a crank angle position signal including a train of pulses corresponding to rotational angles of a crankshaft of the internal combustion engine and specific signal pulses which are used to obtain a plurality of reference crank angle positions of respective cylinders of the internal combustion engine;

cylinder identification signal generation means for generating a cylinder identification signal including a train of pulses corresponding to the respective cylinders in accordance with the rotation of at least one of an intake-side cam and an exhaust-side cam which are caused to rotate at a ratio of ½ with respect to the rotational speed of the crankshaft and move to an advance angle position or a retard angle position under variable valve timing (VVT) control;

reference crank angle position detection means for detecting said plurality of reference crank angle positions based on the specific signal pulse positions of said crank angle position signal;

reference crank angle position identification means for identifying correlation between said plurality of reference crank angle positions and cylinder groups based on a combination of said plurality of reference crank angle positions and said cylinder identification signal;

cylinder identification range setting means for setting cylinder identification ranges of a prescribed angular length with each of said reference crank angle positions as a reference in consideration of an advance angle and a retard angle according to the VVT control; and cylinder identification means for identifying the cylinders based on the reference crank angle positions whose correlation with said cylinder groups within each of said cylinder identification ranges is specified and said cylinder identification signal.

2. The cylinder identification apparatus for a VVT controlled internal combustion engine according to claim 1, wherein said cylinder identification signal generation means generates two cylinder identification signals each corresponding to the cylinders of the internal combustion engine in accordance with the rotations of said intake-side and exhaust-side cams, respectively, said cylinder identification signals having same reference cam angle patterns arranged in phase with each other.

3. The cylinder identification apparatus for a VVT controlled internal combustion engine according to claim 2, further comprising fail safe processing means for using one of said two cylinder identification signals generated by said cylinder identification signal generation means as a fail safe signal, the other of said two cylinder identification signals being used by said cylinder identification means.

4. The cylinder identification apparatus for a VVT controlled internal combustion engine according to claim 3, wherein said fail safe processing means uses the one of said cylinder identification signals for the purposes of normality confirmation thereof and a backup operation.

5. The cylinder identification apparatus for a VVT controlled internal combustion engine according to claim 4, further comprising a memory for storing the history of at least one of three kinds of signals including said crank angle position signal and said two cylinder identification signals, wherein said fail safe processing means confirms normality of said signals from the history of said at least one signal thus stored.

6. The cylinder identification apparatus for a VVT controlled internal combustion engine according to claim 3, further comprising a memory for storing the history of at least one of three kinds of signals including said crank angle position signal and said two cylinder identification signals, wherein said fail safe processing means confirms normality of said signals from the history of said at least one signal thus stored.

7. The cylinder identification apparatus for a VVT controlled internal combustion engine according to claim 1, wherein said cylinder identification signal generation means generates two cylinder identification signals each corresponding to the cylinders of the internal combustion engine in accordance with the rotations of said intake-side and exhaust-side cams, respectively, said cylinder identification signals having same reference cam angle patterns arranged out of phase from each other.

8. The cylinder identification apparatus for a VVT controlled internal combustion engine according to claim 4, further comprising fail safe processing means for using one of said two cylinder identification signals generated by said cylinder identification signal generation means as a fail safe signal, the other of said two cylinder identification signals being used by said cylinder identification means.

9. The cylinder identification apparatus for a VVT controlled internal combustion engine according to claim 8, wherein said fail safe processing means uses the one of said cylinder identification signals for the purposes of normality confirmation thereof and a backup operation.

10. The cylinder identification apparatus for a VVT controlled internal combustion engine according to claim 9, further comprising a memory for storing the history of at least one of three kinds of signals including said crank angle position signal and said two cylinder identification signals, wherein said fail safe processing means confirms normality of said signals from the history of said at least one signal thus stored.

11. The cylinder identification apparatus for a VVT controlled internal combustion engine according to claim 8, further comprising a memory for storing the history of at least one of three kinds of signals including said crank angle position signal and said two cylinder identification signals, wherein said fail safe processing means confirms normality of said signals from the history of said at least one signal thus stored.

12. The cylinder identification apparatus for a VVT controlled internal combustion engine according to claim 7, wherein said cylinder identification means identifies the cylinders based on said two intake-side and exhaust-side cylinder identification signals generated by said cylinder identification signal generation means in said cylinder identification ranges.

13. The cylinder identification apparatus for a VVT controlled internal combustion engine according to claim 7, further comprising fail safe processing means for confirming normality of three kinds of signals including said crank angle position signal and said two cylinder identification signals, wherein when either one of said three signals becomes abnormal, said cylinder identification means identifies the cylinders according to a combination of the other two signals.

14. The cylinder identification apparatus for a VVT controlled internal combustion engine according to claim 13, further comprising a memory for storing the history of at least one of three kinds of signals including said crank angle position signal and said two cylinder identification signals, wherein said fail safe processing means confirms normality of said signals from the history of said at least one signal thus stored.

* * * * *